US007401548B2

(12) United States Patent
Kohno et al.

(10) Patent No.: US 7,401,548 B2
(45) Date of Patent: Jul. 22, 2008

(54) MOVABLE PLATE DRIVE DEVICE AND PRESS SLIDE DRIVE DEVICE

(75) Inventors: Yasuyuki Kohno, Sagamihara (JP); Minoru Somukawa, Sagamihara (JP)

(73) Assignee: Aida Engineering, Ltd., Sagamihara-Shi, Kanagawa (JP)

( * ) Notice: Subject to any disclaimer, the term of this patent is extended or adjusted under 35 U.S.C. 154(b) by 0 days.

(21) Appl. No.: 11/813,783

(22) PCT Filed: Dec. 20, 2005

(86) PCT No.: PCT/JP2005/023411

§ 371 (c)(1),
(2), (4) Date: Jul. 12, 2007

(87) PCT Pub. No.: WO2006/075488

PCT Pub. Date: Jul. 20, 2006

(65) Prior Publication Data

US 2008/0134909 A1 Jun. 12, 2008

(30) Foreign Application Priority Data

Jan. 12, 2005 (JP) ..... 2005-005384

(51) Int. Cl.
*B30B 1/18* (2006.01)
*B30B 15/14* (2006.01)

(52) U.S. Cl. ..... 100/289; 100/48; 100/269.12; 100/269.14; 100/270; 100/290

(58) Field of Classification Search ..... 100/43, 100/48, 269.01, 270, 269.05, 269.12, 269.14, 100/289, 290; 60/413, 414, 418, 446, 448, 60/476; 72/21.5, 443, 453.03, 454
See application file for complete search history.

(56) References Cited

U.S. PATENT DOCUMENTS

| | | | | |
|---|---|---|---|---|
| 4,563,889 | A | | 1/1986 | Landwehr |
| 5,445,773 | A | * | 8/1995 | Arai ..... 264/40.1 |
| 5,692,404 | A | * | 12/1997 | Kirii et al. ..... 72/15.1 |
| 6,085,520 | A | * | 7/2000 | Kohno ..... 60/414 |
| 6,647,870 | B2 | * | 11/2003 | Kohno ..... 100/269.14 |
| 2002/0096060 | A1 | | 7/2002 | Kohno |

FOREIGN PATENT DOCUMENTS

| | | | |
|---|---|---|---|
| EP | 1 213 132 | A3 | 5/2003 |
| JP | 1-309797 | A | 12/1989 |
| JP | 7-37484 | U | 7/1995 |
| JP | 7-266086 | A | 10/1995 |
| JP | 2506657 | B2 | 4/1996 |
| JP | 10-166199 | A | 6/1998 |
| JP | 2000-254799 | A | 9/2000 |
| JP | 2001-205495 | A | 7/2001 |
| JP | 2002-172499 | A | 6/2002 |

* cited by examiner

*Primary Examiner*—Jimmy T Nguyen
(74) *Attorney, Agent, or Firm*—Darby & Darby P.C.

(57) ABSTRACT

A slide of a press machine is driven by composite thrust of thrust of an electric (servo) motor SM (via a screw/nut mechanism from the electric motor) and thrust of hydraulic cylinders SYL1, SYL2 to which pressure oil is supplied from a constant, high pressure source. A slide control device controls the electric motor SM and the hydraulic cylinders SYL1, SYL2, based on a slide position signal and a motor angular velocity signal, and at the same time, makes the hydraulic cylinder SYL1 work as a pump during a period when slide load is small, charging pressure oil to the constant, high pressure source by using the thrust transferred from the electric motor to the hydraulic cylinder SYL1 through the screw/nut mechanism and the slide.

35 Claims, 29 Drawing Sheets

——:COMPOSITE THRUST

- - - - - -:CYLINDER THRUST

—·—:SERVO MOTOR THRUST

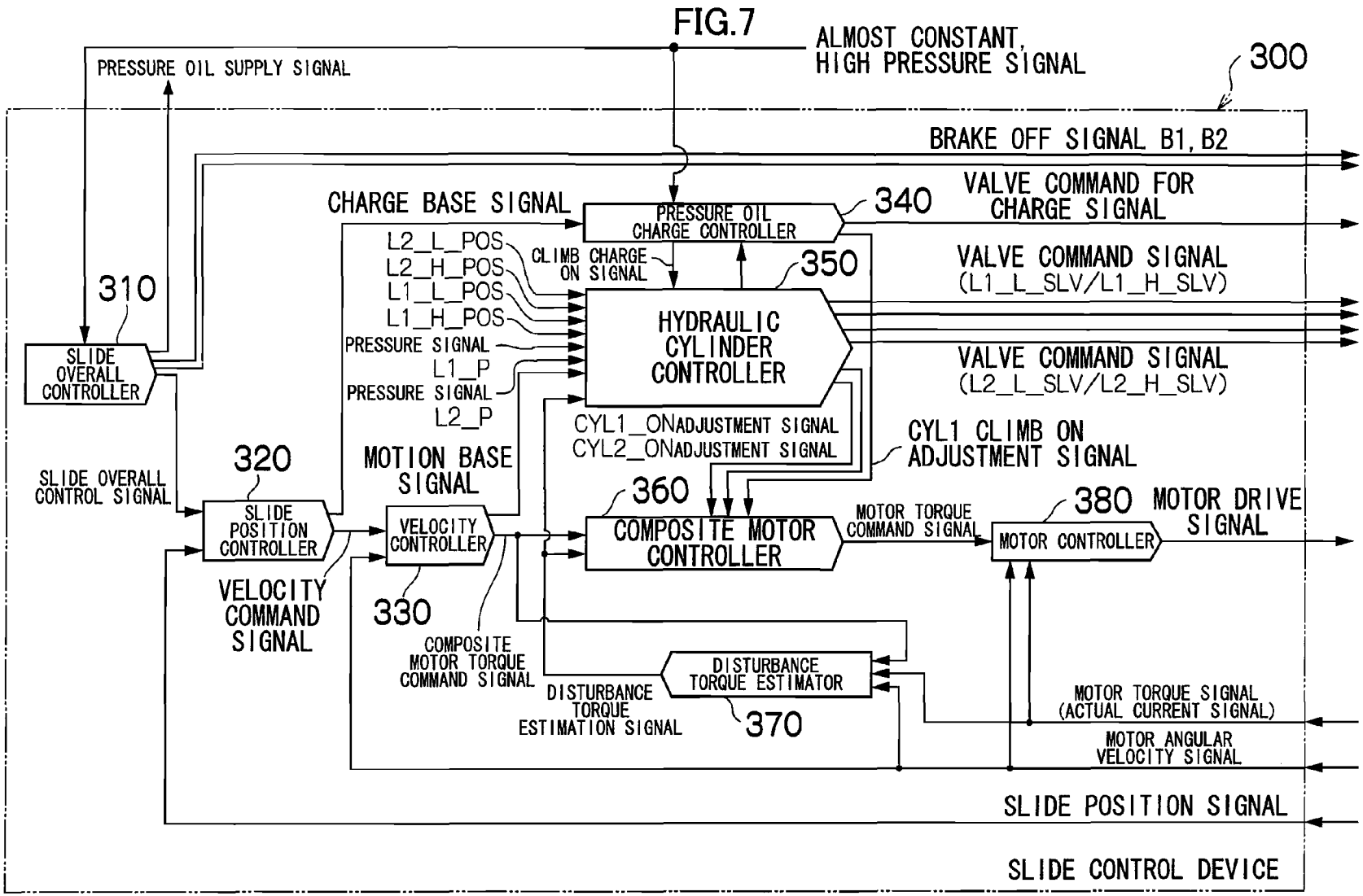
FIG.7
300
ALMOST CONSTANT, HIGH PRESSURE SIGNAL
BRAKE OFF SIGNAL B1, B2
VALVE COMMAND FOR CHARGE SIGNAL
VALVE COMMAND SIGNAL (L1_L_SLV/L1_H_SLV)
VALVE COMMAND SIGNAL (L2_L_SLV/L2_H_SLV)
CYL1 CLIMB ON ADJUSTMENT SIGNAL
MOTOR DRIVE SIGNAL
380
MOTOR CONTROLLER
MOTOR TORQUE SIGNAL (ACTUAL CURRENT SIGNAL)
MOTOR ANGULAR VELOCITY SIGNAL
SLIDE POSITION SIGNAL
SLIDE CONTROL DEVICE
340
PRESSURE OIL CHARGE CONTROLLER
350
HYDRAULIC CYLINDER CONTROLLER
MOTOR TORQUE COMMAND SIGNAL
CYL1_ONADJUSTMENT SIGNAL
CYL2_ONADJUSTMENT SIGNAL
360
COMPOSITE MOTOR CONTROLLER
DISTURBANCE TORQUE ESTIMATOR
370
CHARGE ON SIGNAL
CLIMB ON SIGNAL
CHARGE BASE SIGNAL
L2_L_POS
L2_H_POS
L1_L_POS
L1_H_POS
PRESSURE SIGNAL L1_P
PRESSURE SIGNAL L2_P
MOTION BASE SIGNAL
VELOCITY CONTROLLER
330
COMPOSITE MOTOR TORQUE COMMAND SIGNAL
DISTURBANCE TORQUE ESTIMATION SIGNAL
320
SLIDE POSITION CONTROLLER
VELOCITY COMMAND SIGNAL
PRESSURE OIL SUPPLY SIGNAL
310
SLIDE OVERALL CONTROLLER
SLIDE OVERALL CONTROL SIGNAL CYL2_OFF COMMAND
1
0
ACCORDING TO CYL2 DECOMPRESSION CONTROL IN ASSIST ALGORITHM
SETTING IN ASSIST-OFF (STEADY) MODE

L2_L_SLV
0 (FULLY CLOSED)
SETTING IN ASSIST-ON MODE

L2_H_SLV
0 (FULLY CLOSED)
DELAY TIME
CYL2 DECOMPRESSION CONTROL IN ASSIST TIME

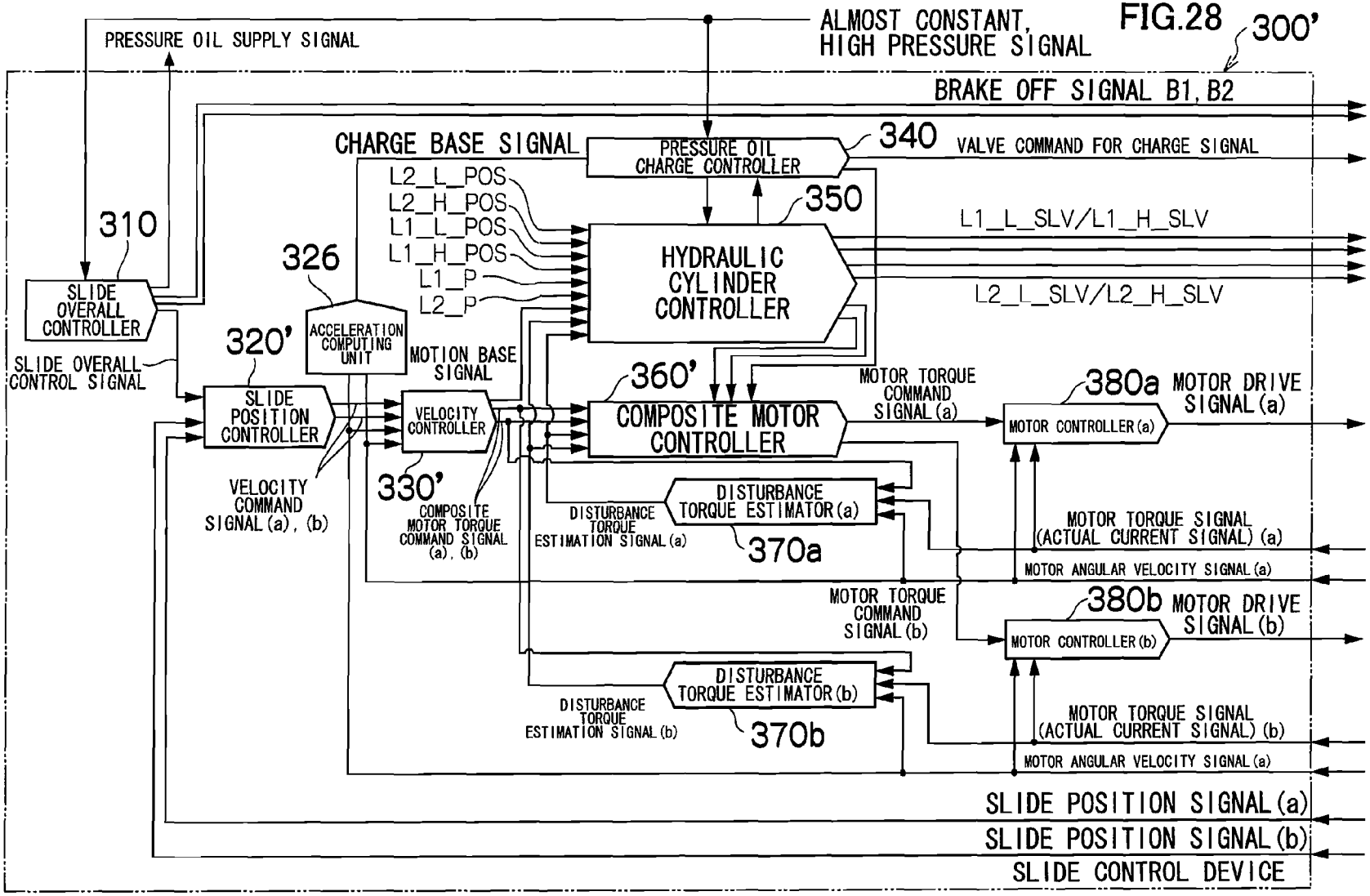
FIG.28
300'
ALMOST CONSTANT, HIGH PRESSURE SIGNAL
BRAKE OFF SIGNAL B1, B2
VALVE COMMAND FOR CHARGE SIGNAL
L1_L_SLV/L1_H_SLV
L2_L_SLV/L2_H_SLV
MOTOR DRIVE SIGNAL (a)
380a
MOTOR CONTROLLER (a)
MOTOR TORQUE SIGNAL (ACTUAL CURRENT SIGNAL) (a)
MOTOR ANGULAR VELOCITY SIGNAL (a)
380b
MOTOR DRIVE SIGNAL (b)
MOTOR CONTROLLER (b)
MOTOR TORQUE SIGNAL (ACTUAL CURRENT SIGNAL) (b)
MOTOR ANGULAR VELOCITY SIGNAL (a)
SLIDE POSITION SIGNAL (a)
SLIDE POSITION SIGNAL (b)
SLIDE CONTROL DEVICE
340
350
PRESSURE OIL CHARGE CONTROLLER
HYDRAULIC CYLINDER CONTROLLER
MOTOR TORQUE COMMAND SIGNAL (a)
360'
COMPOSITE MOTOR CONTROLLER
DISTURBANCE TORQUE ESTIMATOR (a)
370a
DISTURBANCE TORQUE ESTIMATION SIGNAL (a)
MOTOR TORQUE COMMAND SIGNAL (b)
DISTURBANCE TORQUE ESTIMATOR (b)
370b
DISTURBANCE TORQUE ESTIMATION SIGNAL (b)
CHARGE BASE SIGNAL
L2_L_POS
L2_H_POS
L1_L_POS
L1_H_POS
L1_P
L2_P
MOTION BASE SIGNAL
VELOCITY CONTROLLER
330'
COMPOSITE MOTOR TORQUE COMMAND SIGNAL (a), (b)
ACCELERATION COMPUTING UNIT
326
SLIDE POSITION CONTROLLER
320'
VELOCITY COMMAND SIGNAL (a), (b)
PRESSURE OIL SUPPLY SIGNAL
310
SLIDE OVERALL CONTROLLER
SLIDE OVERALL CONTROL SIGNAL

MOVABLE PLATE DRIVE DEVICE AND PRESS SLIDE DRIVE DEVICE

CROSS REFERENCE TO PRIOR RELATED APPLICATIONS

This application is a U.S. national phase application under 35 U.S.C. § 371 of International Patent Application No. PCT/JP2005/023411, filed Dec. 20, 2005, and claims the benefit of Japanese Patent Application No. 2005-005384, filed Jan. 12, 2005, both of which are incorporated by reference herein. The International Application was published in Japanese on Jul. 20, 2006 as International Publication No. WO 2006/075488 A1 under PCT Article 21(2).

FIELD OF THE INVENTION

The present invention relates to a drive device of a movable platen and a slide drive device of a press machine, and particularly to a technology for driving a slide of a press machine or a movable platen of industrial machinery or construction equipment requiring a variety of thrusts, by using an electric motor and a hydraulic cylinder together.

BACKGROUND (a) A Slide Drive Device of a Press Machine Driven by an Electric Servo Motor Japanese Patent No. 2506657 discloses an electric press for driving a slide directly or indirectly (via a speed reducer etc.) only by using an electric motor (electric servo motor). This electric press can provide high controllability of the slide, but working capacity (energy capacity) which is an important capacity factor for a press or a forming machine can not be secured (insufficient). This means that driving by the electric motor does not have a storage function of energy, and large power can not be continuously discharged due to internal heat generation of the motor, and at forming, an amount of energy provided by the motor is limited.

To solve this problem, it is necessary to prepare an electric motor having a considerably large power (W), and to correspond to it, receiving electricity (facilities) of a user may be huge. Further, during uniform motion of a slide not involving acceleration, deceleration or forming, the electric motor performs only a small workload involved in an extremely small load torque, so that the residual torque (energy) of the electric motor may not be efficiently used.

(b) A Slide Drive Device of a Press Machine Driven by a Variable Delivery Pump+(a Plurality of) Hydraulic Motors (Linked to Each Other in a Closed Circuit)+a Screw U.S. Pat. No. 4,563,889 discloses a slide drive device of a press machine of which slide is driven by a variable delivery pump+a hydraulic motor+a screw. When this slide drive device of a press machine drives the slide, a problem arises in controllability (responsivity or static accuracies (of velocity or position) of the slide.

That is, because force necessary to drive the slide is proportional to pressure (load pressure) generated from compression of oil flow discharged by the variable delivery pump per unit time in a pipe line connected to the hydraulic motor when load is applied, dynamic characteristics of the slide are lowered by delay in response caused due to this compression (responsivity, or a feedback gain of velocity or position may be lowered). Further, a leakage of pressure oil proportional to the load pressure occurs in the variable delivery pump, the hydraulic motor or valves, so that, especially, accuracies of velocity and position are largely lowered during forming when the load pressure is high. Moreover, because driving is carried out, based on oil flow control by the variable delivery pump, a large amount of oil flowing per unit time becomes necessary, so facilities may be enlarged thereby.

On the contrary, a fly wheel may be provided between the electric motor and the variable delivery pump, and it has a storage function of energy, so that, there is no limitation with respect to energy. Further, there is also a device of the type in that a crankshaft of a press machine is driven by a similar hydraulic circuit (Japanese Patent Application Laid-Open No. 01-309797), but besides the problem described above, problems in control further occur that a transfer characteristic from a drive shaft driven by the hydraulic motor to the slide is nonlinear, and a value of force applied to the slide is limited.

(c) Japanese Patent Application Laid-Open No. 10-166199 discloses a hydraulic drive plastic working device in which an electric motor rotationally drives a constant delivery pump, and a hydraulic cylinder or a hydraulic motor connected to the pump drives a movable platen. This device has a problem that, because a pressure oil medium intervenes in a drive part (because of an effect of compressibility of hydraulic oil or a leakage of pressure oil), controllability included in the electric motor is considerably lowered. Moreover, the problem specific to control of the electric motor that the motor does not have the storage function of energy, and the problem of heat generated in a coil, just as there are, remain. Accordingly, force applied to a press and a work load necessary for press-forming is limited by maximum instantaneous power of the electric motor. An advantage is limited to the point that a system may be simply configured.

(d) Japanese Patent Application Laid-Open No. 2002-172499 discloses a slide drive device which drives a slide via a screw/nut mechanism, by an electric motor and a constant delivery hydraulic pump/motor in parallel. This device is configured in a manner that turning forces applied by both the electric motor and the constant delivery hydraulic pump/motor are combined together and transferred to the screw/nut mechanism.

(e) Japanese Patent Application Laid-Open No. 07-266086 discloses a ram drive device in a plate working machine, in which a direct drive force of a screw pressure device driven by a servo motor, and a direct drive force of a hydraulic cylinder (hydraulic device) including a variable delivery pump or a constant delivery pump as a power source can be transferred to a slide, respectively. In this ram drive device, the screw pressure device mainly positions the ram during a to-and-from drive, and the hydraulic device mainly pressurizes during plate working, and thereby, a high accuracy of positioning can be achieved and a plate can be worked with a large pressurizing force (see the paragraph [0056] in Japanese Patent Application Laid-Open No. 07-266086).

The slide drive device of a press machine disclosed in Japanese Patent Application Laid-Open No. 2002-172499 has the following problem.

(1) Energy Efficiency

A hydraulic motor driven by a constant pressure source has poor energy efficiency, because a leakage of hydraulic oil is large in the hydraulic motor and a friction loss is also large.

(2) Controllability

Drop in controllability (drop in responsivity or limitation to securing a proportional gain in a feedback control configuration) occurs, because an increase in rigidity of the screw/nut mechanism and the drive shaft is caused and moment of inertia converted at an electric motor axis is increased, since turning forces of both the electric motor and the constant delivery hydraulic pump/motor are combined together and transferred to the screw/nut mechanism.

(3) Cost

The constant delivery hydraulic pump/motor is expensive from the viewpoint of marketability or the number of parts.

(4) Noises

The constant delivery hydraulic pump/motor generates pulsing noises at switching between high pressure and low pressure proportional to an angular velocity, and is a noise source.

On the one hand, the ram drive device in a plate working machine disclosed in Japanese Patent Application Laid-Open No. 07-266086 uses the hydraulic cylinder, and so, it does not have the problems (1) to (4) described above. In this drive device, a hydraulic device controls pressure during plate working as described above, and the hydraulic device directly supplies hydraulic oil from the variable delivery pump or the constant delivery pump to an upper room of the hydraulic cylinder. Therefore, it is possible to secure pressurizing force and energy as desired, but problems arise that controllability is considerably lost, because of compressibility of hydraulic oil or a leakage of pressure oil, and further, it is difficult to control the pressurizing force accurately in high responsivity.

Moreover, the hydraulic device described in Japanese Patent Application Laid-Open No. 07-266086 has to drive the variable delivery pump or the constant delivery pump to supply hydraulic oil to the hydraulic cylinder during plate working, and so, also as the motor for driving the pump, a motor having a large power is required.

SUMMARY OF THE INVENTION

The present invention was made from the viewpoints of such circumferences, and an object of the present invention is to provide a drive device of a movable platen which has a large pressurizing capability using an electric motor and a hydraulic cylinder together, can totally control the movable platen accurately according to characteristics of the electric motor, and has a good energy efficiency, and a slide drive device of a press machine.

To achieve the object described above, a drive device of a movable platen according to one embodiment of the present invention includes: an electric motor device, a screw/nut mechanism which transfers output torque of the electric motor to the movable platen as thrust to move the movable platen, one or more hydraulic cylinders connected to a constant, high pressure source for generating working fluid of almost constant pressure and a low pressure source via a valve, a thrust transfer device which transfers thrust of the one or more hydraulic cylinders to the movable platen and linking to allow the thrust to be transferred as required at an arbitrary stroke position of the screw/nut mechanism, a velocity detecting device which detects a velocity of the movable platen or an angular velocity of any rotation part disposed between a drive shaft of the electric motor and the screw/nut mechanism, and a control device which controls the electric motor device and the hydraulic cylinder, based on the velocity or the angular velocity detected by the velocity detecting device, and is characterized in that: when the thrust generated by the electric motor is insufficient for the thrust to move the platen, the control device controls the electric motor and the hydraulic cylinders to secure the required thrust at the arbitrary stroke position by offset-driving the electric motor and turning on/off the one or more cylinders depending on a magnitude of a shortage of the thrust to continuously change a composite thrust of the electric motor device and the one or more hydraulic cylinders, the control device makes at least one of the hydraulic cylinders serve as a pump during a predetermined period when load of the movable platen is small, and working fluid is charged from the low pressure source to the high pressure source by using thrust transferred from the electric motor to the hydraulic cylinder through the screw/nut mechanism, the movable platen and the thrust transfer device, and wherein the movable platen is a slide of a press machine.

That is, the output torque of the electric motor is applied to the movable platen as a linear drive force through the screw/nut mechanism. Further, the thrust of the one or more hydraulic cylinders connected to the constant, high pressure source and the low pressure source via the valve is allowed to be transferred to the movable platen as required at an arbitrary stroke position of the screw/nut mechanism through the thrust transfer device, and the output torque and the pressure of the cylinder are combined with each other on a force level. Then, the electric motor device and the hydraulic cylinder are controlled, based on the velocity of the movable platen or the angular velocity of any rotation part disposed between the drive shaft of the electric motor device and the screw/nut mechanism, which allows motion of the movable platen to be controlled accurately according to controllability of the electric motor. On the one hand, a shortage in pressurizing force of the electric motor is made up by an assist pressure of the hydraulic cylinder. Specifically, when the thrust generated by the electric motor is insufficient for the thrust to move the platen, the control device controls the electric motor device and the hydraulic cylinders to secure the required thrust at the arbitrary stroke position by offset-driving the electric motor and turning on/off the one or more cylinders depending on a magnitude of a shortage of the thrust to continuously change a composite thrust of the electric motor and the one or more hydraulic cylinders. Further, the hydraulic cylinder works as a pump, whereby, a residual torque of the electric motor device can be charged to the constant, high pressure source as pressure fluid energy, and further, kinetic energy of the movable platen during deceleration can be charged (recovered) to the constant, high pressure source as the pressure fluid energy.

In one embodiment, a hydraulic device including the constant, high pressure source, the low pressure source and the hydraulic cylinder, in which working fluid circulates, is isolated from the atmosphere. Accordingly, the working fluid may be protected against contamination of impurities.

Optionally, the constant, high pressure source may include an accumulator for holding working fluid in an almost constant, high pressure. Pressure fluid discharged when the hydraulic cylinder works as a pump is charged to the accumulator.

The low pressure source may include an accumulator for storing working fluid in a tank at the atmosphere or holding the working fluid in an almost constant, low pressure.

Additionally, the constant, high pressure source may be connected to a working fluid auxiliary supply device which supplies the working fluid of an almost constant pressure. The working fluid may be charged to the constant, high pressure source by operating the hydraulic cylinder as a pump, and the working fluid auxiliary supply device supplies the working fluid to the constant, high pressure source when operation is started or an amount of the working fluid to pressurize the movable platen is insufficient.

The electric motor device may include a plurality of electrically-operated motors having at least one servo motor.

Additionally, the output torque of the electric motor device may be transferred to the screw/nut mechanism through a speed reducer.

The drive device may have two or more cylinders each having a different diameter.

The drive device may have a pair of hydraulic cylinders having an equal diameter, and the pair of hydraulic cylinders are located at a position symmetrical about the center of the movable platen, respectively, and pressure fluid connecting ports of the pair of hydraulic cylinders are connected to each other so as to allow the working fluid to be supplied at the same time. The movable platen may be pressurized in a well-balanced manner according to the pair of hydraulic cylinders, and the pair of hydraulic cylinders may be controlled by a single control system.

The pressure fluid connecting port of at least one of the hydraulic cylinders on the side of a piston rod of the hydraulic cylinder may be connected to the low pressure source so as to always communicate with it.

The movable platen can be movably directed vertically, and the pressure fluid connecting port of the hydraulic cylinder on the side of a cylinder lower room is connected to a pilot operated check valve to support a weight of the movable platen when it is not being driven.

Optionally the drive device can include a velocity command device which commands a target velocity of the movable platen or a target angular velocity of the rotation part, wherein the control device controls the electric motor and the hydraulic cylinder, based on the target velocity or the target angular velocity commanded by the velocity command device and the velocity or the angular velocity detected by the velocity detecting device. That is, the electric motor device and the hydraulic cylinder are controlled in a velocity feedback configuration.

The drive device can also include a position command device which commands a target position of the movable platen or a target angle of the rotation part, and a position detecting device which detects a position of the movable platen or an angle of the rotation part, wherein the control device controls the electric motor device and the hydraulic cylinder, based on the target position or the target angle commanded by the position command device, the position or the angle detected by the position detecting device, and the velocity or the angular velocity detected by the velocity detecting device. That is, the electric motor and the hydraulic cylinder are controlled in a position feedback configuration having a minor loop of velocity feedback.

The control device may include: a composite motor torque command computing device which computes a composite motor torque command signal to control the electric motor, based on the target position or the target angle commanded by the position command device, the position or the angle detected by the position detecting device, and the velocity or the angular velocity detected by the velocity detecting device; and a motor control device which controls the electric motor device, based on the composite motor torque command signal.

The drive device can also include a position command device which commands a target position of the movable platen or a target angle of the rotation part; and a position detecting device which detects a position of the movable platen or an angle of the rotation part, characterized in that the control device includes: a motion base computing device which computes a motion base signal to control the hydraulic cylinder, based on the target position or the target angle commanded by the position command device, the position or the angle detected by the position detecting device, and the velocity or the angular velocity detected by the velocity detecting device; and a cylinder control device which controls the hydraulic cylinder, based on the motion base signal.

The drive device can additionally include a position command device which commands a target position of the movable platen or a target angle of the rotation part, and a position detecting device which detects a position of the movable platen or an angle of the rotation part, wherein the control device includes: a motion base computing device which computes a motion base signal to control the hydraulic cylinder, based on the target position or the target angle commanded by the position command device, the position or the angle detected by the position detecting device, and the velocity or the angular velocity detected by the velocity detecting device; a composite motor torque command computing device which computes a composite motor torque command signal to control the electric motor device, based on the target position or the target angle commanded by the position command device, the position or the angle detected by the position detecting device, and the velocity or the angular velocity detected by the velocity detecting device; a disturbance torque estimating device which computes a disturbance torque estimation signal indicating disturbance torque by estimating the disturbance torque caused due to motion of the movable platen, based on the composite motor torque command signal, and the velocity or the angular velocity detected by the velocity detecting device; and a cylinder control device which controls the hydraulic cylinder, based on the motion base signal and the disturbance torque estimation signal.

The drive device may include a position command device which commands a target position of the movable platen or a target angle of the rotation part, and a position detecting device which detects a position of the movable platen or an angle of the rotation part, characterized in that the control device includes: a composite motor torque command computing device which computes a composite motor torque command signal to control the electric motor, based on the target position or the target angle commanded by the position command device, the position or the angle detected by the position detecting device, and the velocity or the angular velocity detected by the velocity detecting device; a disturbance torque estimating device which computes a disturbance torque estimation signal indicating disturbance torque by estimating the disturbance torque caused due to motion of the movable platen, based on the composite motor torque command signal, and the velocity or the angular velocity detected by the velocity detecting device: and a motor control device which controls the electric motor, based on the composite motor torque command signal and the disturbance torque estimation signal.

As shown above, based on the composite motor torque command signal, and the velocity of the movable platen or the angular velocity of the rotation part detected, the disturbance torque generated due to motion of the movable platen is estimated. Then, the cylinder control device controls the hydraulic cylinder, based on the motion base signal and the disturbance torque estimation signal, and similarly, the motor control device controls the electric motor, based on the composite motor torque command signal and the disturbance torque estimation signal.

The control device can control the hydraulic cylinder by controlling opening of the valve.

The control device control the electric motor device, based on responsivity from generation of a command signal for commanding opening of the valve to the time when pressure of the hydraulic cylinder reaches a predetermined value.

Because working fluid of an almost constant pressure is applied to the hydraulic cylinder from the constant, high pressure source, given a command to open the valve, pressure of the hydraulic cylinder will reach a predetermined value after a required delayed time in response. The control device controls the electric motor device while considering responsivity of the hydraulic cylinder, accordingly, a continuous thrust can be generated for a thrust command continuously changing.

This embodiment can include a position command device which commands a target position of the movable platen or a target angle of the rotation part, wherein the control device includes: a composite motor torque command computing device which computes a composite motor torque command signal to control the electric motor, based on the target position or the target angle commanded by the position command device, the position or the angle detected by the position detecting device, and the velocity or the angular velocity detected by the velocity detecting device; and a motor control device which controls the electric motor device, based on the composite motor torque command signal, first responsivity from generation of a command signal for commanding opening of the valve to the time when pressure of the hydraulic cylinder reaches a predetermined value and second responsivity from commanding a torque command or a current command to the electric motor to the time when the commanded torque or current is reached. The control device controls the electric motor device while considering both of the first responsivity of the hydraulic cylinder and the second responsivity of the electric motor device.

The drive device can optionally include a position command device which commands a target position of the movable platen or a target angle of the rotation part, and a pressure detecting device which detects a pressure of the hydraulic cylinder, wherein the control device includes: a composite motor torque command computing device which computes a composite motor torque command signal to control the electric motor device, based on the target position or the target angle commanded by the position command device, the position or the angle detected by the position detecting detects, and the velocity or the angular velocity detected by the velocity detecting device; and a motor control device which controls the electric motor device, based on the composite motor torque command signal and the pressure detected by the pressure detecting device.

The control device controls the electric motor device while considering the responsivity of the hydraulic cylinder, and further controls the electric motor device according to the pressure of the hydraulic cylinder detected by the pressure detecting device (pressure responsivity).

The drive device can also include a pressure detecting device which detects a pressure of the hydraulic cylinder and an opening detecting device which detects opening of the valve, wherein the control device includes: a computing device which computes a hydraulic cylinder control signal to control the hydraulic cylinder, based on the velocity or the angular velocity detected by the velocity detecting device; and a cylinder control device which controls the hydraulic cylinder, based on the hydraulic cylinder control signal, the pressure detected by the pressure detecting device and the opening detected by the opening detecting device.

The control device controls the hydraulic cylinder (opening of the valve) so that the pressure detected by the pressure detecting device follows the hydraulic cylinder control signal (pressure command).

Further, the computing device can compute the hydraulic cylinder control signal indicating a cylinder pressure changing between two steady states, i.e. a state of an almost constant, low pressure and a state of an almost constant, high pressure, and the cylinder control device controls the hydraulic cylinder only during a transient period of the cylinder pressure of the hydraulic cylinder changing between the two steady states, based on the hydraulic cylinder control signal, the pressure detected by the pressure detecting device and the opening detected by the opening detecting device.

The cylinder control device controls the hydraulic cylinder (opening of the valve) only during a transient period in response when the pressure of the hydraulic cylinder is raised or lowered to a predetermined pressure (an almost constant, high pressure of the constant, high pressure source, or an almost constant, low pressure of the low pressure source).

The valve can include a first valve intervening between the constant, high pressure source and the hydraulic cylinder, and a second valve intervening between the low pressure source and the hydraulic cylinder, and the control device controls the first and second valve in a manner that the second valve is opened after the first valve is closed, or the first valve is opened after the second valve is closed.

Optionally, the control device includes: a computing device which computes a hydraulic cylinder control signal indicating a cylinder pressure changing between two steady states, i.e. a state of an almost constant, low pressure (P0) and a state of an almost constant, high pressure (P1); and a valve control device which controls the valve, based on the hydraulic cylinder control signal, wherein the valve has opening and responsivity where change in pressure at least equal to or more than 50% of |P1−P0| can be achieved between the two steady states within 60 msec at the latest from the time of change of the hydraulic cylinder control signal. That is, a rising edge of the pressure of the hydraulic cylinder is proportional to an amount of working fluid supplied through the valve and to increase this amount of the fluid, it is necessary to enhance responsivity of the valve and increase the opening of the valve.

The drive device can further include an acceleration detecting device which detects an acceleration of the movable platen or an angular acceleration of the rotation part, wherein the control device makes at least one of the hydraulic cylinders work as a pump, based on the angular velocity or the angular acceleration detected by the acceleration detecting device. That is, based on a detection output of the acceleration detecting device, a period when the movable platen is not in an acceleration region where a comparatively large torque is required (a period when drive load of the movable platen is small) is detected, during this period, the hydraulic cylinder works as a pump, and the residual torque of the electric motor device is charged to the constant, high pressure source as pressure fluid energy.

In this embodiment the acceleration detecting device may compute the acceleration or the angular acceleration, based on the velocity or the angular velocity detected by the velocity detecting device.

Also, the control device may include an acceleration computing device which computes an angular velocity or an angular acceleration, based on the target velocity or the target angular velocity commanded by the velocity command device, and makes at least one of the hydraulic cylinders work as a pump, based on the angular velocity or the angular acceleration computed.

Two or more of the electric motor devices can be connected to one screw/nut drive mechanism.

Alternatively a plurality of the screw/nut drive mechanisms can be provided for one movable platen, and the electric motor device is separately provided for each screw/nut drive mechanism.

The hydraulic cylinder may have a plurality of independent, pressure receiving surfaces capable of operating in the same direction.

In one embodiment the drive device can include a position command device which commands a target position of the movable platen or a target angle of the rotation part; a first position detecting device which detects a position of the movable platen or an angle of the rotation part; and a second position detecting device which detects a position of the movable platen rather than the position detected by the first position detecting device, or an angular velocity of a rotation part associated with the screw/nut drive mechanism rather than the rotation part in the plurality of the screw/nut drive mechanisms disposed in the movable platen, wherein the velocity detecting device includes: a first velocity detecting device which detects a velocity of the movable platen at a position or an angular velocity of any rotation part disposed between the drive shaft of the electric motor device and the screw/nut mechanism; and a second velocity detecting device which detects a velocity of the movable platen at a position rather than the position at which the first velocity detecting device detects the velocity of the movable platen, or an angular acceleration of a rotation part associated with the screw/nut drive mechanism rather than the rotation part in the plurality of the screw/nut drive mechanisms disposed in the movable platen, and the control device controls a plurality of the electric motor devices and the hydraulic cylinder, based on the target position or the target angle commanded by the position command device, the position or the angle detected by the first and second position detecting device, and the velocity or the angular velocity detected by the first and second velocity detecting device.

Alternatively, the control device can include a first composite motor torque command computing device which computes a first composite motor torque command signal to control a first electric motor device of a plurality of the electric motor devices, based on the target position or the target angle commanded by the position command device, the position or the angle detected by the first position detecting device, and the velocity or the angular velocity detected by the first velocity detecting device; a second composite motor torque command computing device which computes a second composite motor torque command signal to control a second electric motor device for driving the screw/nut drive mechanism rather than one driven by the first electric motor device, based on the target position or the target angle commanded by the position command device, the position or the angle detected by the second position detecting device, and the velocity or the angular velocity detected by the second velocity detecting device; a first disturbance torque estimating device which computes a first disturbance torque estimation signal indicating first disturbance torque by estimating the first disturbance torque caused due to motion of the movable platen, based on the first composite motor torque command signal, and the velocity or the angular velocity detected by the first velocity detecting device; a second disturbance torque estimating device which computes a second disturbance torque estimation signal indicating second disturbance torque by estimating the second disturbance torque caused due to motion of the movable platen, based on the second composite motor torque command signal, and the velocity or the angular velocity detected by the second velocity detecting device; a first motor control device which controls the first electric motor device, based on the first composite motor torque command signal and the first disturbance torque estimation signal; and a second motor control device which controls the second electric motor device, based on the second composite motor torque command signal and the second disturbance torque estimation signal.

Because the control device according to these embodiments controls the electric motor devices separately provided for each screw/nut drive mechanism, respectively, even when external load or disturbance is eccentrically applied to the movable platen, in response to it, thrust control of the electric motor device can be performed.

In addition the drive device can include a position command device which commands a target position of the movable platen or a target angle of the rotation part; and a position detecting device which detects a position of the movable platen or an angle of the rotation part, wherein a plurality of the hydraulic cylinders are disposed for one movable platen, and the velocity detecting device includes: a first velocity detecting device which detects a velocity of the movable platen or an angular velocity of any rotation part disposed between the drive shaft of the electric motor device and the screw/nut mechanism; and a second velocity detecting device which detects a velocity of the movable platen at a position rather than the position at which the first velocity detecting device detects the velocity of the movable platen, or an angular acceleration of a rotation part associated with the screw/nut drive mechanism rather than the rotation part in the plurality of the screw/nut drive mechanisms disposed in the movable platen, and the control device includes: a composite motor torque command computing device which computes a composite motor torque command signal to control the electric motor device, based on the target position or the target angle commanded by the position command device, the position or the angle detected by the position detecting device, and at least one velocity or angular velocity of the velocities or the angular velocities detected by the first and second velocity detecting devices, respectively; a motion base computing device which computes a motion base signal to control the hydraulic cylinder, based on the target position or the target angle commanded by the position command device, the position or the angle detected by the position detecting device, and at least one velocity or angular velocity of the velocities or the angular velocities detected by the first and second velocity detecting devices, respectively; a first disturbance torque estimating device which computes a disturbance torque estimation signal indicating first disturbance torque by estimating the first disturbance torque caused due to motion of the movable platen, based on the composite motor torque command signal, and the velocity or the angular velocity detected by the first velocity detecting device; a second disturbance torque estimating device which computes a disturbance torque estimation signal indicating second disturbance torque by estimating the second disturbance torque caused due to motion of the movable platen, based on the composite motor torque command signal, and the velocity or the angular velocity detected by the second velocity detecting device; a first cylinder control device which controls a first hydraulic cylinder of the plurality of the hydraulic cylinders, based on the motion base signal and the first disturbance torque estimation signal; and a second cylinder control device which controls a second hydraulic cylinder of the plurality of the hydraulic cylinders, based on the motion base signal and the second disturbance torque estimation signal.

In one embodiment a plurality of the screw/nut drive mechanisms are provided for one movable platen, and the electric motor device is separately provided for each screw/nut drive mechanism, and the position detecting device includes: a first position detecting device which detects a position of the movable platen or an angle of the rotation part; and a second position detecting device which detects a position of the movable platen rather than the position which the first position detecting device detects, or an angular velocity of a rotation part associated with the screw/nut drive mechanism rather than the rotation part in the plurality of the screw/nut drive mechanisms disposed in the movable platen, and the composite motor torque command signal computing device includes: a first composite motor torque command computing device which computes a first composite motor torque command signal to control a first electric motor device of a plurality of the electric motor devices, based on the target position or the target angle commanded by the position command device, the position or the angle detected by the first position detecting device, and the velocity or the angular velocity detected by the first velocity detecting device; and a second composite motor torque command computing device which computes a second composite motor torque command signal to control a second electric motor device of the plurality of the electric motor devices, based on the target position or the target angle commanded by the position command device, the position or the angle detected by the second position detecting device, and the velocity or the angular velocity detected by the second velocity detecting device, and the first disturbance torque estimating device computes the disturbance torque estimation signal indicating first disturbance torque by estimating the first disturbance torque caused due to motion of the movable platen, based on the first composite motor torque command signal, and the velocity or the angular velocity detected by the first velocity detecting device, the second disturbance torque estimating device computes the disturbance torque estimation signal indicating second disturbance torque by estimating the second disturbance torque caused due to motion of the movable platen, based on the second composite motor torque command signal, and the velocity or the angular velocity detected by the second velocity detecting device.

Because the control device according to these embodiments controls the plurality of the hydraulic cylinders, respectively, provided separately for one movable platen, even when external load or disturbance is eccentrically applied to the movable platen, in response to it, thrust control of the hydraulic cylinder can be performed.

According to the present invention, drive torque of an electric motor device is transferred to a movable platen (slide) via a screw/nut mechanism as linear drive force, and further, it is combined in a force level with thrust of a hydraulic cylinder to be transferred to the movable platen, and also, the electric motor device and the hydraulic cylinder are controlled at least in velocity. Therefore, a large pressurizing capability can be provided, and according to characteristics of the electric motor device, the movable platen can be highly accurately controlled in totally. Moreover, the hydraulic cylinder has a better energy efficiency because of low leakage of working fluid and small friction loss, and further, the residual torque of the electric motor device may be charged to a constant, high pressure source as pressure fluid energy, and kinetic energy of the movable platen during deceleration may be charged (recovered) to the constant, high pressure source as pressure fluid energy.

BRIEF DESCRIPTION OF THE DRAWINGS

FIG. 7 is a block diagram illustrating an internal configuration of a slide control device shown in FIG. 1;

FIG. 28 is a block diagram illustrating an internal configuration of a slide control device shown in FIG. 27.

| Description of Symbols | |
|---|---|
| 100, 100', 100" | press machine |
| 110 | slide |
| 120, 120a, 120b | drive screw |
| 122, 122a, 122b | driven nut |
| 130, 130a, 130b | slide position detector |
| 132, 132a, 132b | drive shaft angular velocity detector |
| 200, 200' | hydraulic cylinder controller |
| 202, 206 | accumulator |
| 204 | constant, high pressure source |
| 208 | low pressure source |
| 210 | valve drive device |
| 200a | first hydraulic cylinder controller |
| 200b | second hydraulic cylinder controller |
| 230 | auxiliary pressure oil supply device |
| 231 | electric motor |
| 232 | hydraulic pump |
| 234, 253, 254 | electromagnetic direction transfer valve |
| 235, 271 | check valve |
| 250 | gravity fall-preventing device |
| 251, 252, 272 | pilot operated check valve |
| 270 | charge drive device |
| 300, 300' | slide control device |
| 310 | slide overall controller |
| 320, 320' | slide position controller |
| 322 | differentiator |
| 323 | integrator |
| 324 | charge signal generator |
| 325 | control computing unit |
| 326 | acceleration computing unit |
| 330, 330' | velocity controller |
| 340 | pressure oil charge controller |
| 350, 350' | hydraulic cylinder controller |
| 360, 360' | composite motor controller |
| 370, 370a, 370b | disturbance torque estimator |
| 380, 380a, 380b | motor controller |
| 390, 390a, 390b | motor drive device |
| SM, SM1a, SM2a, SM1b, SM2b, SMa, SMb | electric motor |
| SYL, SYL1, SYL2, SYL1a, SYL1b, SYL2a, SYL2b | hydraulic cylinder |
| P_H, P_1_D, P_2_D | pressure detector |
| V1_D_H, V1_D_L, V2_D_H, V2_D_L | valve of . . . |
| S1_D_L, S1_D_H, S2_D_L, S2_D_ | spool position detector |

SUMMARY OF THE INVENTION

Now, preferred embodiments of a drive device of a movable platen and a slide drive device of a press machine according to the present invention will be hereinafter described in detail with reference to the accompanying drawings.

Figure 1:
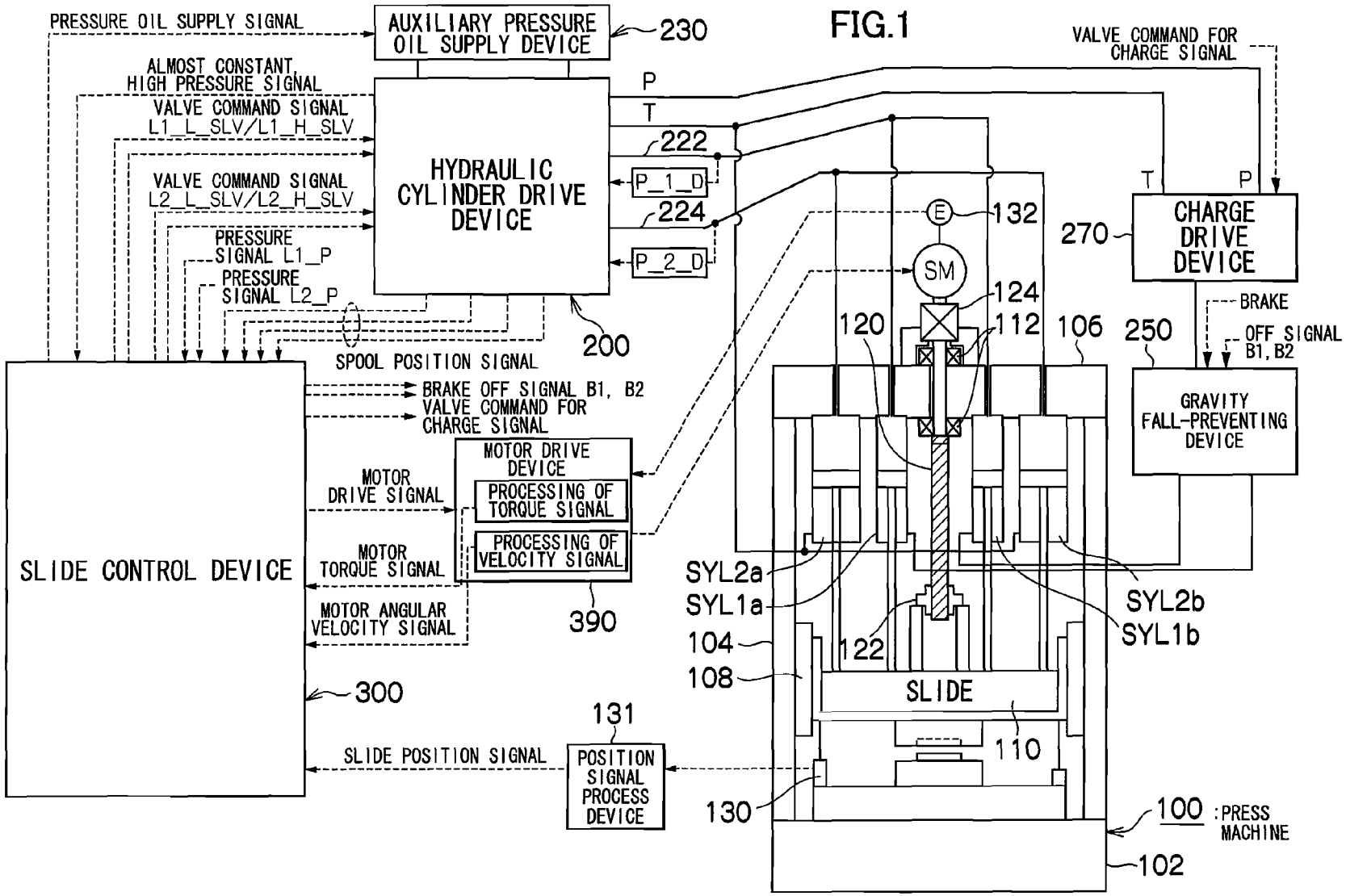
FIG. 1 is a schematic view illustrating an overall configuration of one embodiment of a slide drive device of a press machine according to the present invention.

FIG. 1 is a schematic view illustrating an overall configuration of one embodiment of a slide drive device of a press machine according to the present invention. As shown in FIG. 1, this slide drive device of a press machine mainly includes a press machine 100, a hydraulic cylinder drive device 200, an auxiliary pressure oil supply device 230, a gravity fall-preventing device 250, a charge drive device 270, a slide control device 300 and a motor drive device 390.

The press machine 100 has a frame including a bed 102, a column 104 and a crown 106, and a slide (movable platen) 110 is movably guided vertically by a guide part 108 provided in the column 104.

As drive device of the slide 110, two large hydraulic cylinders SYL2 (SYL2*a*, SYL2*b*) and two small hydraulic cylinders SYL1 (SYL1*a*, SYL1*b*), and a screw/nut mechanism for transferring output torque of an electric (servo) motor SM are provided.

The hydraulic cylinders SYL1 (SYL1*a*, SYL1*b*) are a pair of hydraulic cylinders with a small cylinder diameter, and disposed at a position symmetrical about the center of the slide 110, respectively. Similarly, the hydraulic cylinders SYL2 (SYL2*a*, SYL2*b*) are a pair of hydraulic cylinders with a large cylinder diameter, and disposed at a position symmetrical about the center of the slide 110, respectively. Cylinder bodies of these hydraulic cylinders SYL1, SYL2 are fixed on the crown 106 and piston rods are fixed on the slide 110, and thrust can be transferred to the slide 110 entirely across a stroke of the slide 110.

The screw/nut mechanism includes a drive screw 120 rotatably fixed on the crown 106 through a shaft bearing 112, and a driven nut 122 fixed on the slide 110 and engaging with the drive screw 120, and output torque of the electric motor SM is transferred to the drive screw 120 through a speed reducer 124.

In addition, on the side of the base 102 of the press machine 100, a slide position detector 130 for detecting a position of the slide 110 is provided, and in the electric motor SM, a drive shaft angular velocity detector 132 for detecting an angular velocity of a drive shaft is provided. The slide position detector 130 may include various sensors such as a linear encoder of an incremental type or an absolute type, a potentiometer or a magnescale, and further, the drive shaft angular velocity detector 132 may include a rotary encoder of an incremental type or an absolute type or a tachogenerator.

Next, a principle for combining thrust of the hydraulic cylinders SYL1, SYL2 and thrust of the electric motor SM (obtained via the screw/nut mechanism) will be described.

First, the thrust of the hydraulic cylinders $F_{cyl}$ may be expressed by the following expression:

[Expression 1]

$$F_{cyl}=S_H \cdot P_A - S_R \cdot P_T \tag{1}$$

where, $F_{cyl}$: thrust of hydraulic cylinder [N]

$S_H$: cross-sectional area on the cylinder head side [$m^2$]

$S_R$: cross-sectional area on the cylinder rod side [$m^2$]

$P_A$: pressure acting on the head side of hydraulic cylinder [Pa]

$P_T$: pressure acting on the rod side of hydraulic cylinder [Pa]$\leqq 0$

Oil pressure is generated due to compression of oil flow $Q_A$ supplied through a valve, so that the pressure $P_A$ may be expressed by the following expression:

[Expression 2]

$$P_A=\int K(Q_A/V_A)dt \tag{2}$$

where,

K: bulk modulus of oil [Pa]

$Q_A$: oil flow supplied to hydraulic cylinder [$m^3$/sec]

$V_A$: volume of pipe line on the head side of hydraulic cylinder [$m^3$]

A rising edge of the pressure $P_A$ acting on the head side of the hydraulic cylinder is proportional to the oil flow $Q_A$ supplied through the valve, and to increase the oil flow $Q_A$, enhanced responsivity of the valve, enlarged opening of the valve (increased value of flow coefficient, that is, enhanced flowability), and higher valve differential pressure (existence of a constant, high pressure source) become important. Further, pressure of hydraulic oil supplied from a high pressure source is made to be almost constant, which also has a significance that change in thrust response may be suppressed (made to be constant).

Specifically, it is substantially possible to reduce the time required from commanding to the valve to generation of desired cylinder thrust to be below about 30 msec.

On the one hand, output torque $T_E$ of the electric (servo) motor may be expressed by the following expression:

[Expression 3]

$$T_E = k_E \cdot I \tag{3}$$

where, $k_E$: torque constant [Nm/A]

I: current [A]

Further, thrust $F_E$ transferred to the slide through the screw/nut mechanism may be expressed by the following expression.

[Expression 4]

$$F_E = k_S \cdot T_E \tag{4}$$

where, $T_E$: electric (servo) motor torque [Nm]

$k_S$: proportional constant dependent on screw/nut mechanism [$m^{-1}$]

Response of the thrust $F_E$ is proportional to response of the current I. A response where the electric motor generates drive current after being commanded is good, and a delay in response where the electric motor generates the thrust for a command is small in total.

As described above, to combine the hydraulic cylinder thrust and the electric motor thrust (through the screw/nut mechanism), it is very important that response in both thrusts (dynamic characteristics) is good.

[Static Composition]

The slide control device automatically recognizes an overall torque (required for acceleration and deceleration, forming, viscosity, friction etc.), and combines the torque of one hydraulic cylinder or a plurality of the hydraulic cylinders, when only the thrust of the electric servo motor is insufficient to operate.

Figure 2:
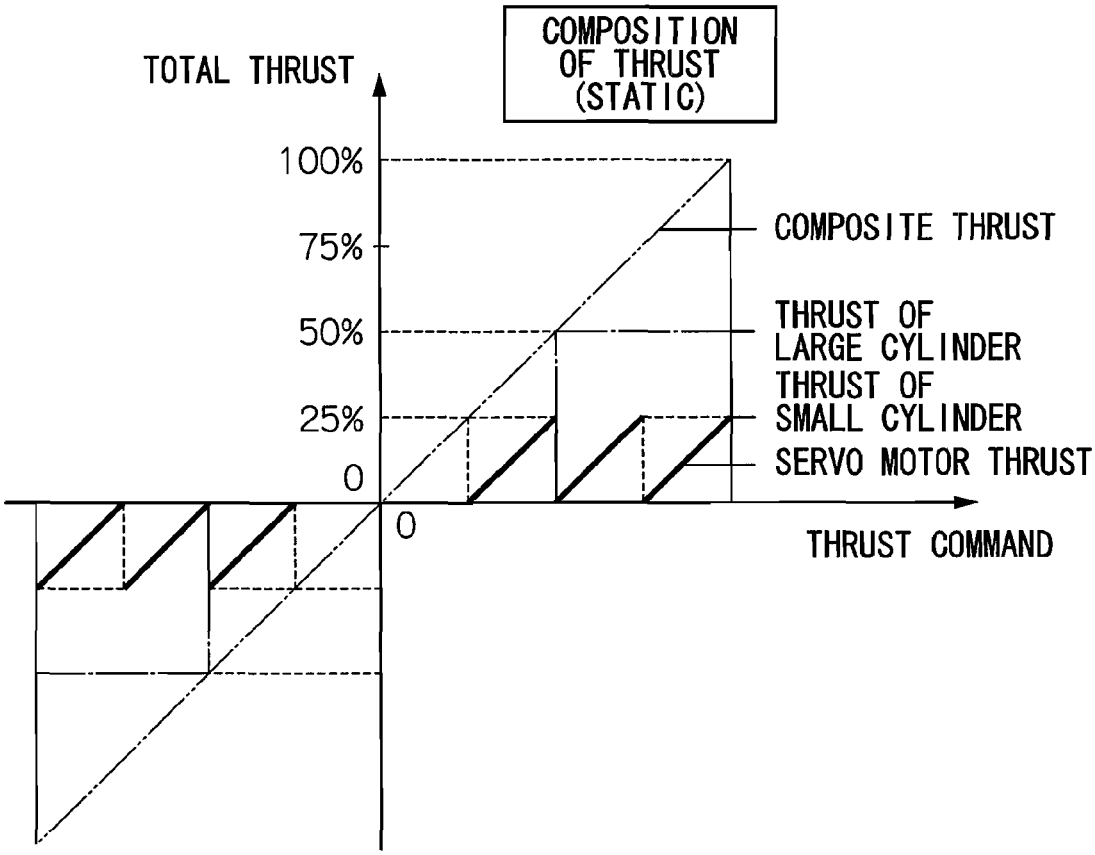
FIG. 2 is a view used for describing a static assist operation of a large and small hydraulic cylinder on an electric motor.

As shown in FIG. 1, when, in the two large hydraulic cylinders SLY2 and the two small hydraulic cylinders SYL1 (or two systems, where systems connected by a pipe line are considered to be one system), the small hydraulic cylinders SYL1 have an thrust equal to a maximum thrust of the thrust (transferred through the screw/nut mechanism) of the electric motor SM for servo control, and the large hydraulic cylinders SYL2 have an thrust twice the maximum thrust of the electric motor SM, then, each thrust of the electric motor SM, and the hydraulic cylinders SYL1, SYL2, and composite torque of these torques in total are combined with each other as shown in FIG. 2. In a principle diagram of FIG. 2, each thrust is shown, when the hydraulic cylinders are driven in two directions, but a hydraulic cylinder of an embodiment described below is configured to be driven to generate thrust only in one direction.

That is, it is supposed that a maximum thrust (100%) of a total thrust of a composite motor is four times as large as the maximum thrust provided only by the electric motor SM, and the total thrust in the range from 0 to 25% is covered with the thrust provided only by the electric motor. When the total thrust is in the range from 25% to 50%, the small hydraulic cylinders SYL1 are turned on, and the electric motor SM drives 25% (the thrust of the small hydraulic cylinders SYL1) for offsetting.

When the total thrust is in the range from 50% to 75%, the small hydraulic cylinders SYL1 are turned off, the large hydraulic cylinders SYL2 are turned on, and the electric motor SM drives 25% (a difference between the thrust of the large hydraulic cylinders SYL2 and the thrust of the small hydraulic cylinders SYL1) for offsetting.

When the total thrust is in the range beyond 75%, in addition to the large hydraulic cylinders SYL2, the small hydraulic cylinders SYL1 are again turned on, and the electric motor SM drives 25% for offsetting. In short, each of the hydraulic cylinders SYL1, SYL2 is turned on/off to secure a required thrust, and the electric motor adjusts so that the thrust acts continuously for a composite thrust command, realizing static thrust characteristics of the composite motor in total.

Figure 3:
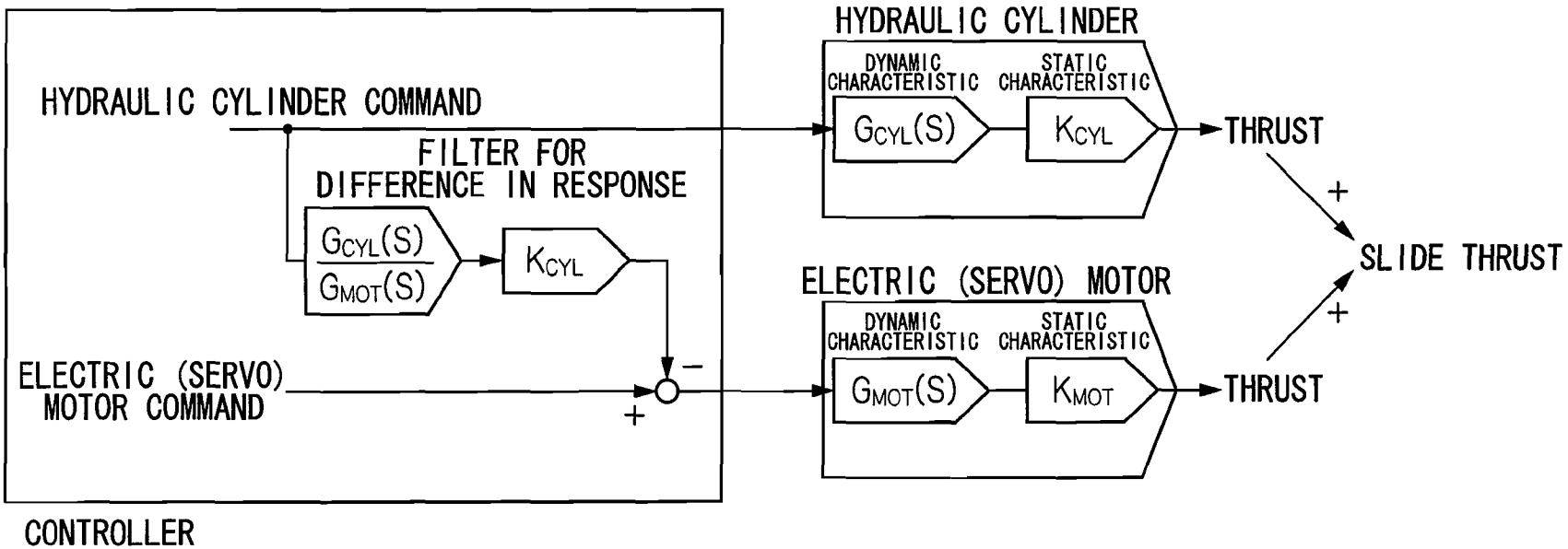
FIG. 3 is a schematic view of a controller for outputting a command to the electric motor and the hydraulic cylinder.

FIG. 3 is a schematic view of a controller for outputting a command to the electric motor and the hydraulic cylinders (SYL1, SYL2).

When the thrust of the hydraulic cylinder SYL is combined with the thrust of the electric motor SM as described above, the controller is configured as shown in FIG. 3 with considering responsivity of the hydraulic cylinder SYL.

That is, there is a difference between responsivity of the electric motor SM and responsivity of the hydraulic cylinder SYL, and so, in the controller shown in FIG. 3, to balance dynamically (transiently) (to match a rising time constant of each thrust) upon composition, the electric motor SM having high responsivity is operated to match response of the hydraulic cylinder SYL, using a filter (transfer function) for difference in rising response between the thrust of the electric motor SM (+screw mechanism) and the thrust of the hydraulic cylinder.

In addition, in FIG. 3, GCYL(S) denotes a transfer function from commanding a control command to the hydraulic cylinder SYL to generation of pressure of the hydraulic cylinder SYL, and GMOT(S) denotes a transfer function from commanding a torque command or a current command to the electric motor to outputting of torque or generation of drive current of the electric motor.

Further, high responsivity (dead band: within about 10 msec, rising time: within about 20 msec) is required for the hydraulic cylinder SYL, and so, the requirements can be satisfied by driving a valve having a large opening to turn to on/off in order to avoid power (viscosity) loss, and using a valve having high responsivity (of a spool or a poppet) which is driven by an almost constant, high pressure source, as shown also in theoretical and experimental confirmation with taking into consideration a compression (generation of oil pressure) time caused due to supplied oil flow.

Figure 4A:
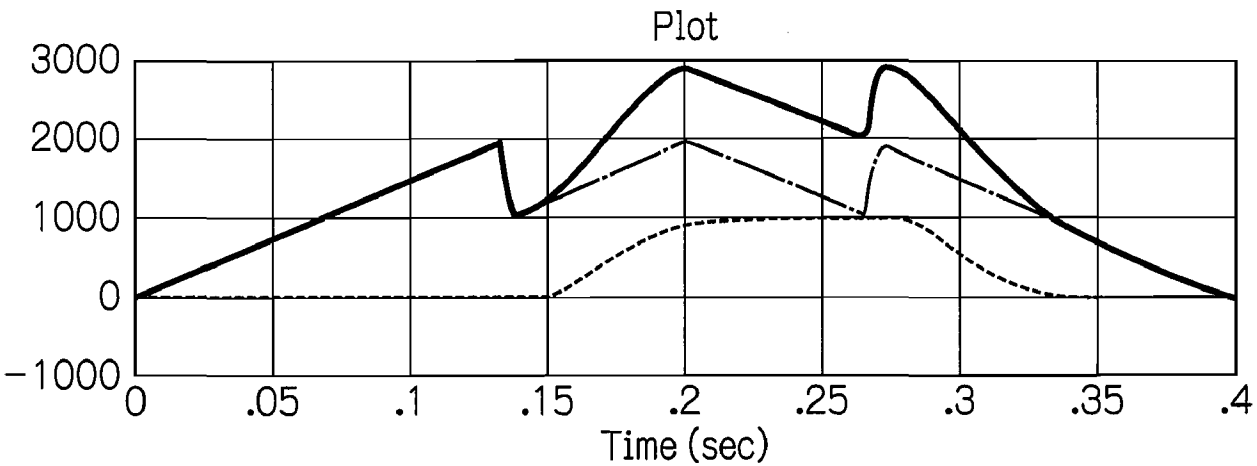
FIGS. 4A and 4B are graphs illustrating relation between thrust of the electric motor, thrust of the large and small hydraulic cylinder and composite thrust formed by combining these thrusts.
Figure 4B:
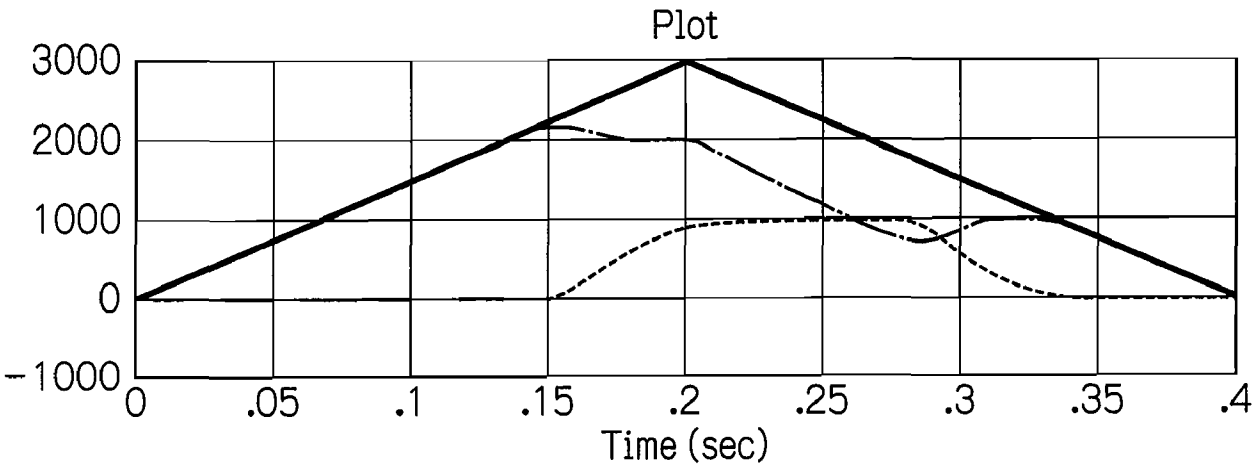

FIGS. 4A and 4B are graphs illustrating relation between each thrust of the electric motor and the hydraulic cylinder, and the composite thrust formed by combining these thrusts, respectively.

In FIG. 4A, when a thrust command is ramped up and down, thrust composition is shown only when statically considered, and so, it may be seen that the composite thrust has discontinuity when not dynamically considered.

On the one hand, in FIG. 4B, when the thrust command is ramped up and down, the thrust composition is shown when statically and dynamically considered, and in this case, it may be seen that the composite thrust continuously changes regardless of on/off of the hydraulic cylinder.

That is, to configure a composite motor of which thrust can continuously change for the thrust command, dynamical consideration is essential which is based on a dynamic characteristic in generation of the cylinder thrust involved in raising pressure, and a dynamic characteristic in generation of the thrust of the servo motor (+the screw/nut mechanism).

Next, the hydraulic cylinder drive device 200 and the auxiliary pressure oil supply device 230 will be described with reference to FIG. 5.

This hydraulic cylinder drive device 200 mainly includes: a constant, high pressure source 204 including an accumulator 202 for holding hydraulic oil of an almost constant, high pressure; a low pressure source 208 including an accumulator 206 for holding hydraulic oil of an almost constant, low pressure; a valve drive device 210; a pair of valves V1_D (V1_D_H, V1_D_L) for driving the hydraulic cylinder SYL1; a pair of valves V2_D (V2_D_H, V2_D_L) for driving the hydraulic cylinder SYL2; a relief valve 220 for high pressure disposed between a pipe line P on the high pressure side connected to the accumulator 202 and a pipe line T on the low pressure side connected to the accumulator 206; a pressure detector P_H for detecting a pressure of hydraulic oil accumulated in the accumulator 202; a pressure detector P_1_D for detecting a circuit pressure of a pipe line 222 connected to the side of a cylinder upper room of the hydraulic cylinder SYL1; a pressure detector P_2_D for detecting a circuit pressure of a pipe line 224 connected to the side of a cylinder upper room of the hydraulic cylinder SYL2; and spool position detectors S1_D_L, S1_D_H, S2_D_L, S2_D_H for detecting each spool position of valves V1_D_H, V1_D_L, V2_D_H, V2_D_L. In addition, the low pressure source 208 may be a tank at the atmosphere.

The pipe line P on the high pressure side is connected to the pipe lines 222, 224 through the valves V1_D_H, V2_D_H, respectively, and the pipe line T on the low pressure side is connected to the pipe lines 222, 224 through the valves V1_D_L, V2_D_L, respectively.

Further, the pipe line P on the high pressure side and the pipe line T on the low pressure side are connected to a charge drive device 250, respectively, and the pipe line T on the low pressure side is directly connected to a cylinder lower room of the hydraulic cylinders SYL2 (SYL2*a*, SYL2*b*) (see FIG. 1).

The valve drive device 210 drives the four valves V1_D_H, V1_D_L, V2_D_H, V2_D_L based on valve command signals L1_L_SLV, L1_H_SLV, L2_L_SLV, L2_H_SLV provided by a hydraulic cylinder controller 350 in the slide control device 300 described below.

The auxiliary pressure oil supply device 230 includes an electric motor 231, a hydraulic pump 232, a filter 233, an electromagnetic direction transfer valve 234 and a check valve 235.

The pressure detector P_H outputs an almost constant, high pressure signal indicating a pressure of hydraulic oil stored in the accumulator 202 to the slide control device 300, and the slide control device 300 outputs a pressure oil supply signal to the auxiliary pressure oil supply device 230, when the almost constant, high pressure signal received reaches not larger than a storage lower limit set pressure during operation (for example, 21.5 MPa) (see FIG. 1).

The electromagnetic direction transfer valve 234 of the auxiliary pressure oil supply device 230 is switched over according to the pressure oil supply signal, and a discharge line (on the holding side of the check valve 235) of the hydraulic pump 232 driven by the electric motor 231 is switched to on-load mode, whereby, pressure oil is accumulated in the constant, high pressure source 204. In addition, during operation, a predetermined pressure (storage upper limit set pressure during operation, for example, 22.5 MPa) is reached, the discharge line is switched to unload mode.

[Gravity Fall-Preventing Device and Charge Drive Device]

Next, the gravity fall-preventing device 250 and the charge drive device 270 shown in FIG. 1 will be described with reference to FIG. 6.

The gravity fall-preventing device 250 prevent the slide 110 from falling due to its own weight, and includes: pilot operated check valves 251, 252 provided in pipe lines of two systems connected to pressure fluid connecting ports on the side of the cylinder lower room of the hydraulic cylinders CYL1*a*, CYL1*b*; electromagnetic direction transfer valves 253, 254; and relief valves 255, 256.

Figure 6:
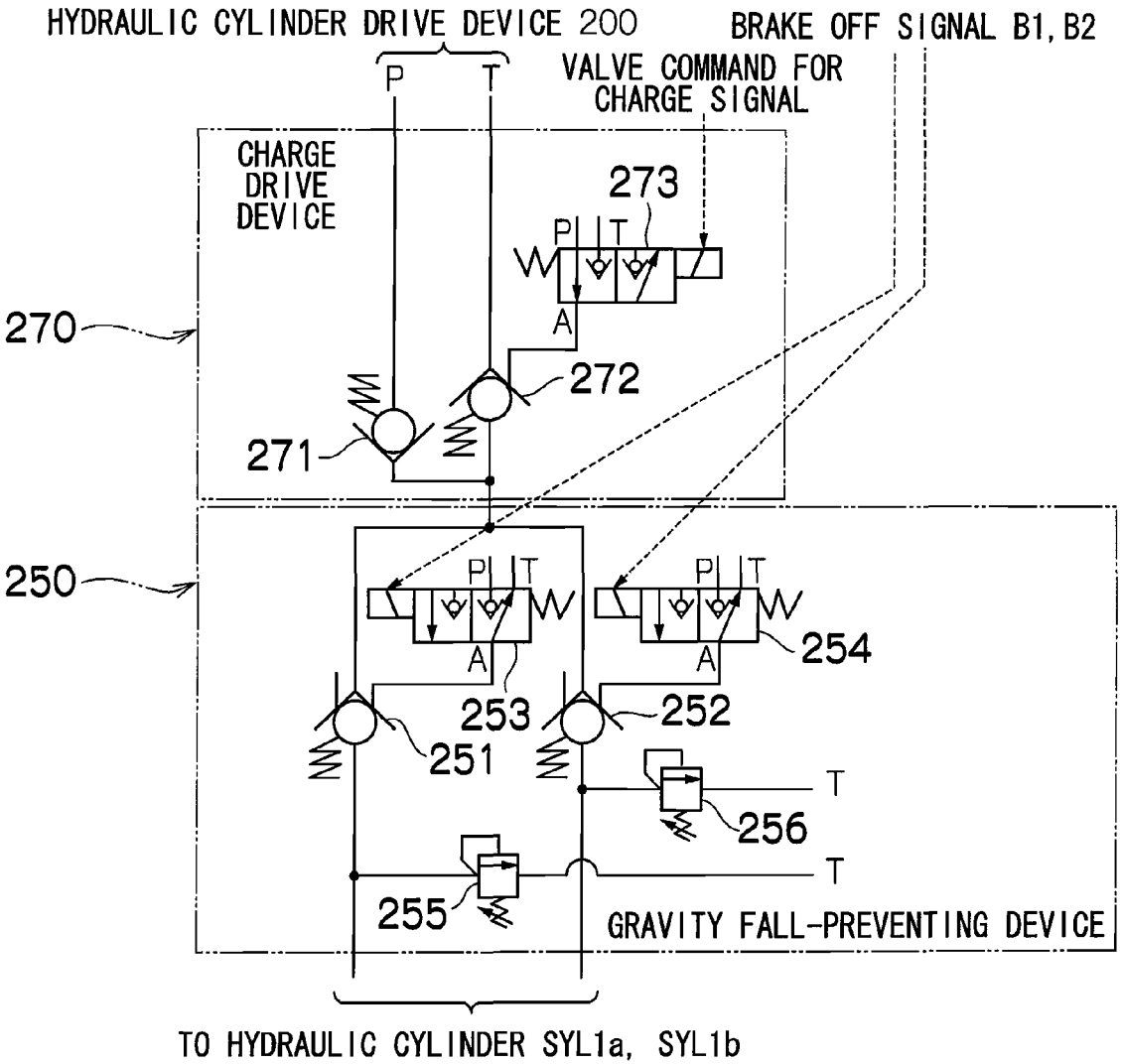
FIG. 6 is a hydraulic circuit diagram illustrating an internal configuration of a gravity fall-preventing device and a charge drive device shown in FIG. 1.

During a period when the press machine 100 is not operated, the slide control device 300 does not output brake off signals B1, B2 to the electromagnetic direction transfer valves 253, 254, and as the result, the electromagnetic direction transfer valves 253, 254 are switched to a position shown in FIG. 6, so that pilot pressure is not output from the electromagnetic direction transfer valves 253, 254 to the pilot operated check valves 251, 252. As shown in FIG. 1, piston rods of the hydraulic cylinders SYL1*a*, SYL1*b* are pulled downward due to slide's 110 own weight, and pressure in the cylinder lower rooms of the hydraulic cylinders SYL1*a*, SYL1*b* is raised, but the pipe lines are blocked by the pilot operated check valves 251, 252 provided in the pipe lines of the two systems connected to the pressure oil connecting ports on the side of the cylinder lower rooms of the hydraulic cylinders CYL1*a*, CYL1*b*, therefore, the slide 110 is prevented from falling due to its own weight.

On the one hand, when the press machine 100 is operated, the slide control device 300 outputs the brake off signals B1, B2 to the electromagnetic direction transfer valves 253, 254, and the electromagnetic direction transfer valves 253, 254 are switched from the position shown in FIG. 6. Accordingly, the pilot pressure is applied from the electromagnetic direction transfer valves 253, 254 to the pilot operated check valves 251, 252, which allows pressure oil to flow in the reverse direction at the pilot operated check valves 251,252.

The charge drive device 270 makes the hydraulic cylinders SYL1*a*, SYL1*b* work as a pump to charge pressure oil to the constant, high pressure source 204, and includes a check valve 271, a pilot operated check valve 272 and an electromagnetic direction transfer valve (charge valve) 273.

The slide control device 300, for a predetermined period for charging, outputs a valve command for charge signal to the charge valve 273, switching the charge valve 273 from a position shown in FIG. 6. Accordingly, pilot pressure is not applied to the pilot operated check valve 272, and a flow path from the cylinder lower rooms of the hydraulic cylinders SYL1*a*, SYL1*b* through the gravity fall-preventing device 250 to the pipe line T on the lower pressure side is blocked, so that pressure oil discharged from the cylinder lower rooms of the hydraulic cylinders SYL1*a*, SYL1*b* during descent of the slide 110 is charged through the pipe line P on the high pressure side via the check valve 271 to the constant, high pressure source 204. In addition, a predetermined period for charging pressure oil will be described in detail below.

Next, the slide control device 300 shown in FIG. 1 will be described with reference to FIG. 7.

The slide control device 300 includes a slide overall controller 310, a slide position controller 320, a velocity controller 330, a pressure oil charge controller 340, hydraulic cylinder controller 350, a composite motor controller 360, a disturbance torque estimator 370 and a motor controller 380.

The slide overall controller 310 totally controls operation of the press machine 100, and outputs a slide overall control signal and the brake off signals B1, B2 during operation of the press machine 100. To the slide overall controller 310, an almost constant, high pressure signal indicating a pressure of the constant, high pressure source 204 is provided from the pressure detector P_H in the hydraulic cylinder drive device 200, and the slide overall controller 310 outputs a pressure oil supply signal to drive the auxiliary pressure oil supply device 230, when the almost constant, high pressure signal received reaches not larger than a storage lower limit set pressure during operation (for example, 21 MPa).

Further, the slide overall controller 310 outputs the brake off signals B1, B2 to the gravity fall-preventing device 250, releasing a gravity fall function of the slide 110 (brake function) during non-operation.

The slide overall control signal provided by the slide overall controller 310 is added to the slide position controller 320. Another input to the slide position controller 320 includes a slide position signal indicating a position of the slide 110 provided by the slide control device 130 for detecting the position of the slide 110 through a position signal process device 131.

Figure 8:
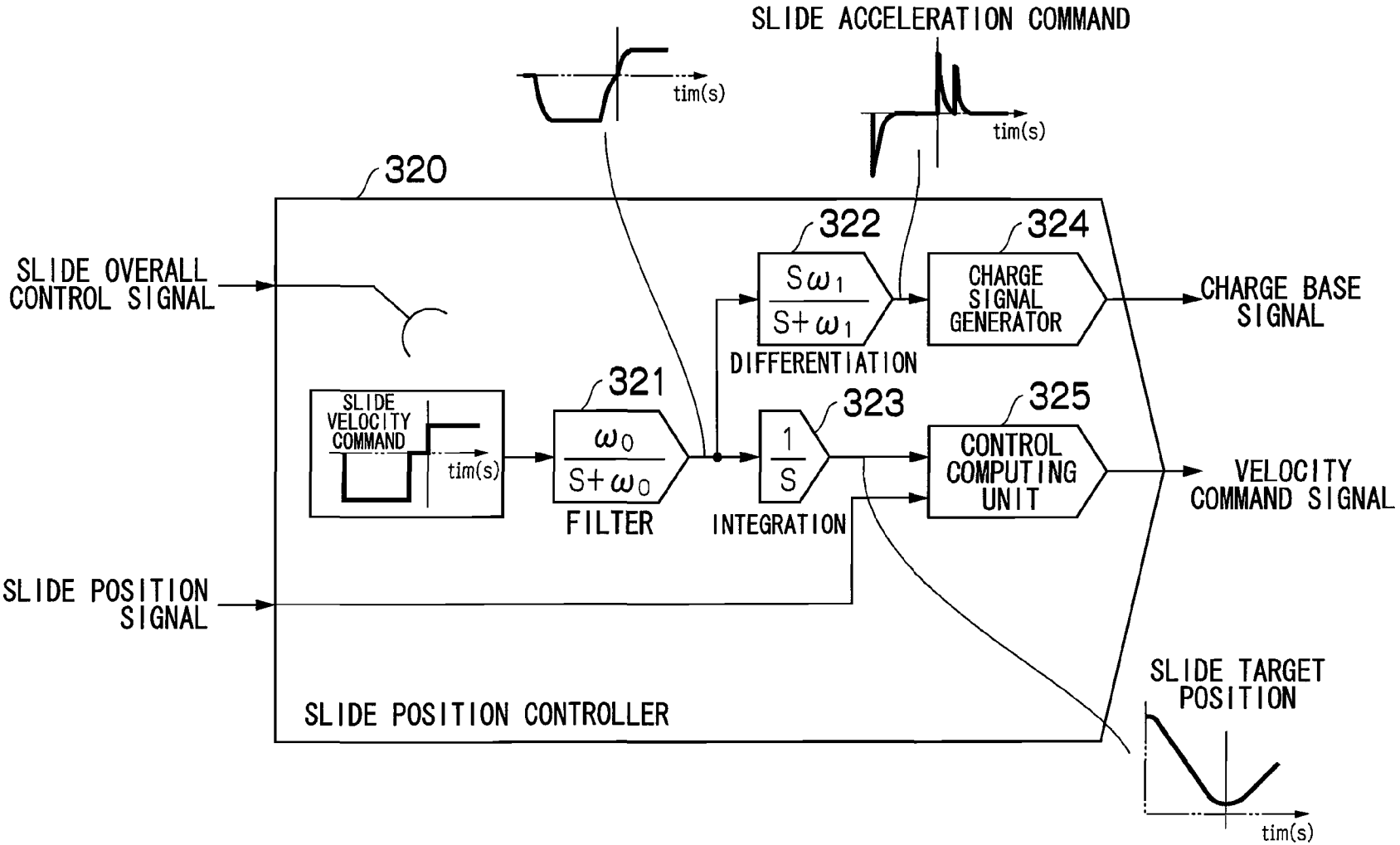
FIG. 8 is a block diagram illustrating an internal configuration of a slide position controller shown in FIG. 7.

FIG. 8 is a diagram illustrating an internal configuration of the slide position controller 320, and this slide position controller 320 includes a filter 321, an integrator 322, a charge signal generator 323, an integrator 324 and a control computing unit 325.

The slide overall control signal provided by the slide overall controller 310 is a slide velocity signal which changes in a step-like manner, and this slide velocity signal is filtered through the filter 321, and subsequently added to the differentiator 322 and the integrator 323.

The slide velocity signal is time-differentiated by the differentiator 322, and subsequently added to the charge signal generator 324 as a slide acceleration command. The charge signal generator 324 determines the time at which a slide acceleration region requiring a comparatively large torque is passed through, according to the slide acceleration command, and outputs a charge base signal forming the basis for controlling the charge drive device 270. In addition, the charge signal generator 324, without usage of actual acceleration signal etc., creates the charge base signal from the computed acceleration command signal. It is because chattering caused by noises abundantly including high frequency components is prevented, but the charge base signal may be created from an actual acceleration signal, a signal obtained by differentiating an actual velocity, or an actual motor torque signal.

On the one hand, the slide velocity signal is time-integrated by the integrator 323, and subsequently added to the control computing unit 325 as a slide target position command signal. Another input to the control computing unit 325 includes the slide position signal, and the control computing unit 325 computes a deviation between the two input signals, determines a control signal (velocity command signal) based on the deviation signal, and outputs this velocity command signal.

Returning to FIG. 7, to one input of the velocity controller 330, the velocity command signal provided from the slide position controller 320 is added, and to the other input of the velocity controller 330, a motor angular velocity signal is provided by the drive shaft angular velocity detector 132 through the motor drive device 390. The velocity controller 330 computes a motion base signal and a composite motor torque command signal for controlling position and velocity, based on these two signals. The motion base signal is output to the hydraulic cylinder controller 350, and the composite motor torque command signal is output to the composite motor controller 360 and the disturbance torque estimator 370.

In addition, the motion base signal is formed, based on the composite motor torque command signal, and, to control the hydraulic cylinder stably in high responsivity, the motion base signal is computed according to some kind of processes of the composite motor torque command signal (which actually drives), based on feedback of position and velocity. For example, the composite motor torque command signal may be filtered with a first-order filter to form the motion base signal, or the composite motor torque command signal may be multiplied by a constant and processed with a saturation function to saturate at some upper or lower limit value, forming the motion base signal. In addition, the case where, depending on the constant or the saturation function, the motion base signal becomes the same as the composite motor torque command signal may be included.

To the disturbance torque estimator 370, besides the composite motor torque command signal, a motor torque signal (actual current signal) provided by a torque detector for detecting a torque (current) of the electric motor SM through the motor drive device 390, and the motor angular velocity signal are added, and the disturbance torque estimator 370 computes to estimate disturbance torque including press load etc., based on the motor angular velocity signal etc. That is, the disturbance torque estimator computes to estimate the disturbance torque, based on a difference between a signal formed by computing to differentiate the motor velocity signal and a computation value obtained by multiplying the composite motor torque command signal by a filter such as a lag element, or a sum of a difference between the signal formed by computing to differentiate the motor velocity signal and the computation value obtained by multiplying the composite motor torque command signal by the filter such as a lag element, and a computed correction value based on the motor torque signal. The disturbance torque estimation signal indicating this estimated disturbance torque is output to the hydraulic cylinder controller 350 and the composite motor controller 360.

The hydraulic charge controller 340 receives the charge base signal indicating entering a uniform motion region from an acceleration motion region during descent, outputs a valve command for charge signal to the charge drive device 270, and receives the charge base signal from the slide position controller 320 and further the almost constant, high pressure signal from the pressure detector P_H. The hydraulic charge controller 340, upon receiving the charge base signal from the slide position controller 320, outputs the valve command for charge signal to turn on the charge valve 273 in the charge drive device 270, and on the one hand, when a signal indicating that the hydraulic cylinder SYL1 is driven for assist is provided by the hydraulic cylinder controller 350, the hydraulic charge controller 340 stops outputting the valve command for charge signal. Further, when the almost constant, high pressure signal provided by the pressure detector P_H reaches the storage upper limit set pressure (for example, 22.5 MPa), also, the hydraulic charge controller 340 stops outputting the valve command for charge signal.

At this time (when the charge drive device is driven during descent), in synchronization with driving of the hydraulic cylinder CYL1 (on the rod side=climb side) by the pressure oil charge controller 340 through the charge drive device 270 via the charge valve 273, a cylinder 1 climb ON adjustment signal (FIG. 7) is output so as to compensate for a difference between thrust response which is proportional to predicted pressure response and predicted torque response of the servo motor SM, and the composite motor controller 360 combines the thrust through the servo motor+the screw/nut mechanism and the thrust of the hydraulic cylinder smoothly even in a dynamic state (even in a transition state), by adding this adjustment signal to an SM torque command.

Further, the hydraulic charge controller 340, also during climb of the slide 110 similarly to descent, outputs a charge ON during climb signal to the hydraulic cylinder controller 350, upon receiving the charge base signal indicating entering a uniform motion region from an acceleration region, when the almost constant, high pressure signal is in a predetermined range. In addition, the hydraulic cylinder controller 350, upon receiving the charge ON during climb signal, controls the valves V1_D_H, V1_D_L so that pressure oil is supplied to lower the hydraulic cylinder SYL1. Accordingly, the hydraulic cylinder SYL1 is operated as a pump during climb of the slide 110 and pressure oil can be charged to the constant, high pressure source 204.

Next, the hydraulic cylinder controller 350 will be described.

The hydraulic cylinder controller 350 outputs valve command signals L1_L SLV, L1_H_SLV, L2_L_SLV, L2_H_SLV to drive (open/close) the four valves V1_D_H, V1_D_L, V2_D_H, V2_D_L, and at the same time, outputs an SYL1_ON adjustment signal and an SYL2_ON adjustment signal corresponding to thrusts generated by the hydraulic cylinders SYL1, SYL2 to the composite motor controller 360, and receives the motion base signal provided by the velocity controller 330 and the disturbance torque estimation signal provided by the disturbance torque estimator 370.

Further, to the hydraulic cylinder controller 350, pressure signals L1_P, L2_P detected by pressure detectors P_1_D, P_2_D, spool position signals L1_L_POS, L1_H_POS, L2_L_POS, L2_H_POS detected by spool position detectors S1_D_L, S1_D_H, S2_D_L, S2_D_H are provided.

The hydraulic cylinder controller 350 determines whether the thrust generated only by the electric motor is sufficient to drive, or whether any one or both of the hydraulic cylinders SYL1, SYL2 are necessary for assisting when assist of the hydraulic cylinders is required, based on a sum total of the motion base signal and the disturbance torque estimation signal provided, and creates CYL1_OFF command to set the hydraulic cylinder SYL1 to an assist-on/assist-off mode, and CYL2_ON command and CYL2_OFF command to set the hydraulic cylinder SYL2 to the assist-on/assist-off mode.

Further, to the CYL1_ON command and the CYL1_OFF command, a climb ON charge signal provided by the pressure oil charge controller 340 is added as required during climb.

Figures 9A, 9B, 9C:
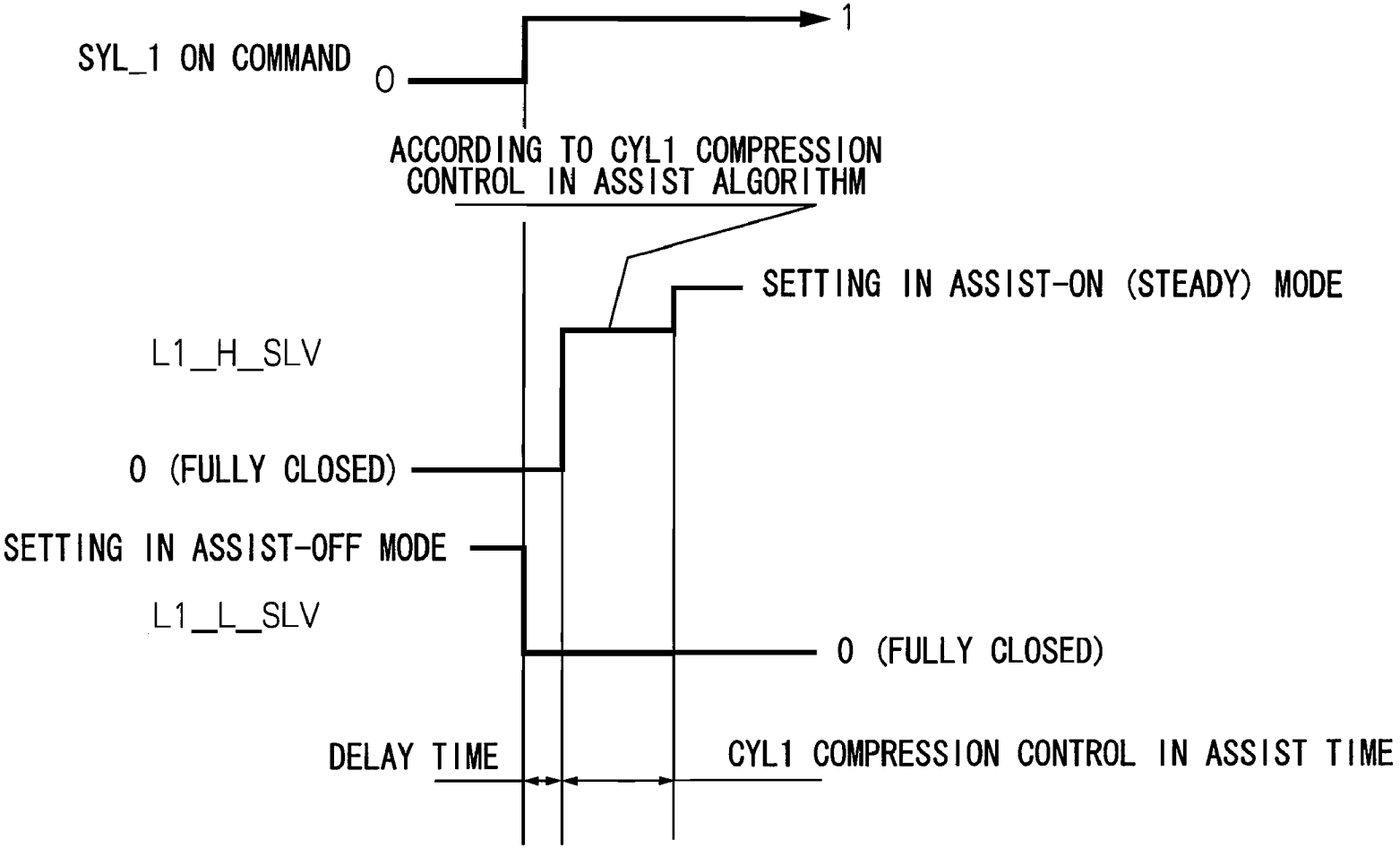
FIGS. 9A to 9C are views illustrating output timing of each command to the hydraulic cylinder during an assist-on mode in a hydraulic cylinder controller shown in FIG. 7.

Now, when the CYL1_ON command (0→1) to set the hydraulic cylinder SYL1 to the assist-on mode is created as shown in FIG. 9A, the valve command signal L1_L_SLV to full close the valve V1_D_L in communication with the low pressure source 208 is output in synchronization with rising of the CYL1_ON command (FIG. 9C), and subsequently, after an elapse of a predetermined delay time, the valve command signal L1_H_SLV to open the valve V1_D_H in communication with the constant, high pressure source 204 according to a compression algorithm upon assist described below is output (FIG. 9B). In addition, the compression algorithm upon assist is performed only for a predetermined time period of compression control upon assist (several msec to several dozen msec) (in a transition period of the cylinder pressure).

Figure 10:
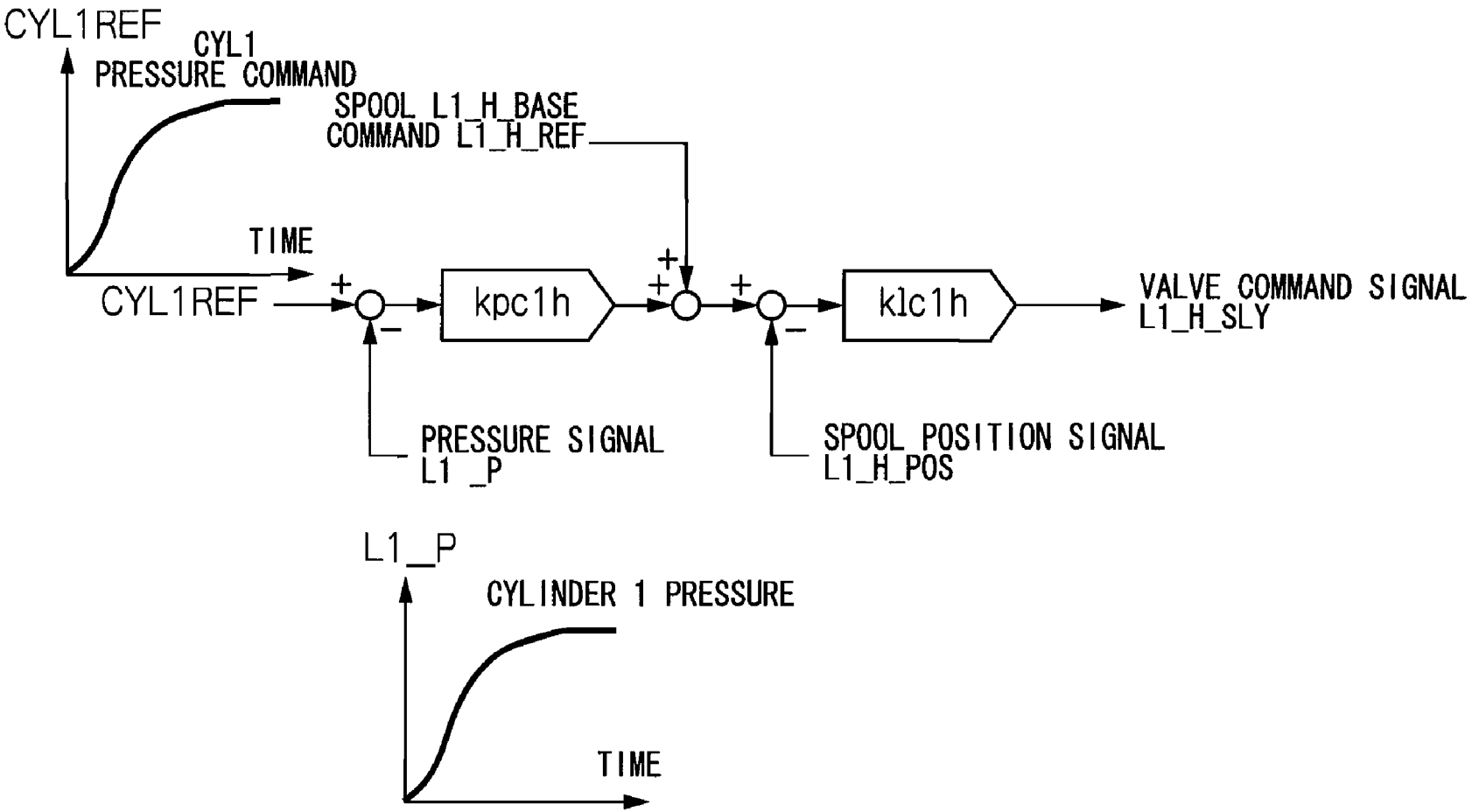
FIG. 10 is a circuit diagram illustrating a part of the hydraulic cylinder controller shown in FIG. 7 during the assist-on mode of the hydraulic cylinder.

FIG. 10 is a circuit diagram illustrating a part of the hydraulic cylinder controller 350 to output the valve command signal L1_H_SLV. As shown in FIG. 10, at the time of compression control upon assist, CYL1 pressure command upon compression CYL1REF is output. The hydraulic cylinder controller 350 computes a spool position command of the valve V1_D_H, based on a deviation between the pressure command CYL1REF and the pressure signal L1_P detected by the pressure detector P_1_D, computes the valve command signal L1_H_SLV, based on a deviation between this spool position command and the spool position signal L1_H_POS detected by the spool position detector S1_D_H, and controls a spool position of the valve V1_D_H (opening) according to this valve command signal L1_H_SLV.

By controlling the valve V1_D_H with the valve command signal L1_H_SLV computed according to the compression algorithm upon assist, the pressure of the hydraulic cylinder SYL1 will follow the pressure command CYL1REF.

Also, after compression according to the compression algorithm upon assist, the valve V1_D_H is controlled to have a constant flow rate for a steady-on state (almost full open opening). It is because, after completion of compression process, the opening of the valve is enlarged so that oil flow is not throttled and energy efficiency is not lowered.

The hydraulic cylinder controller 350, in the case of setting the hydraulic cylinder to the assist-off mode, also performs similar control in the case of the assist-on mode.

Figures 11A, 11B, 11C:
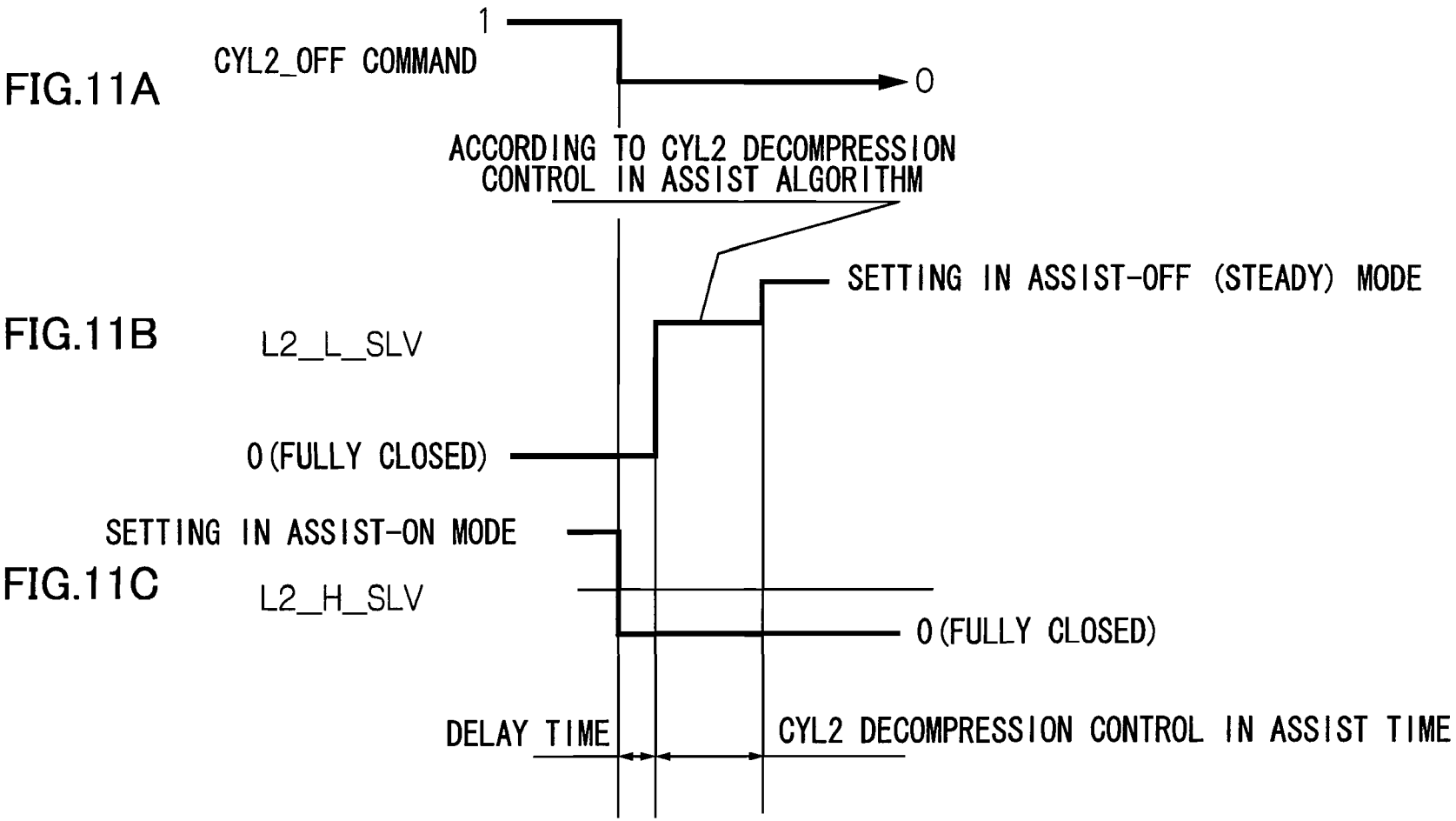
FIGS. 11A to 11C are views illustrating output timing of each command to the hydraulic cylinder during an assist-off mode in the hydraulic cylinder controller shown in FIG. 7.

That is, when the CYL2_OFF command (1→0) to set the hydraulic cylinder SYL2 to the assist-off mode is created as shown in FIG. 11A, the valve command signal L2_H_SLV to full close the valve V2_D_H in communication with the constant, high pressure source 204 is output in synchronization with a falling edge of the CYL2_OFF command (FIG. 11C), and subsequently, after an elapse of a predetermined delay time, the valve command signal L2_L_SLV to open the valve V2_D_L in communication with the low pressure source 208 according to a decompression algorithm upon assist is output (FIG. 11B). In addition, the decompression algorithm upon assist is performed only for a predetermined time period of decompression control upon assist (several msec to several dozen msec) (in a transition period of the cylinder pressure).

Figure 12:
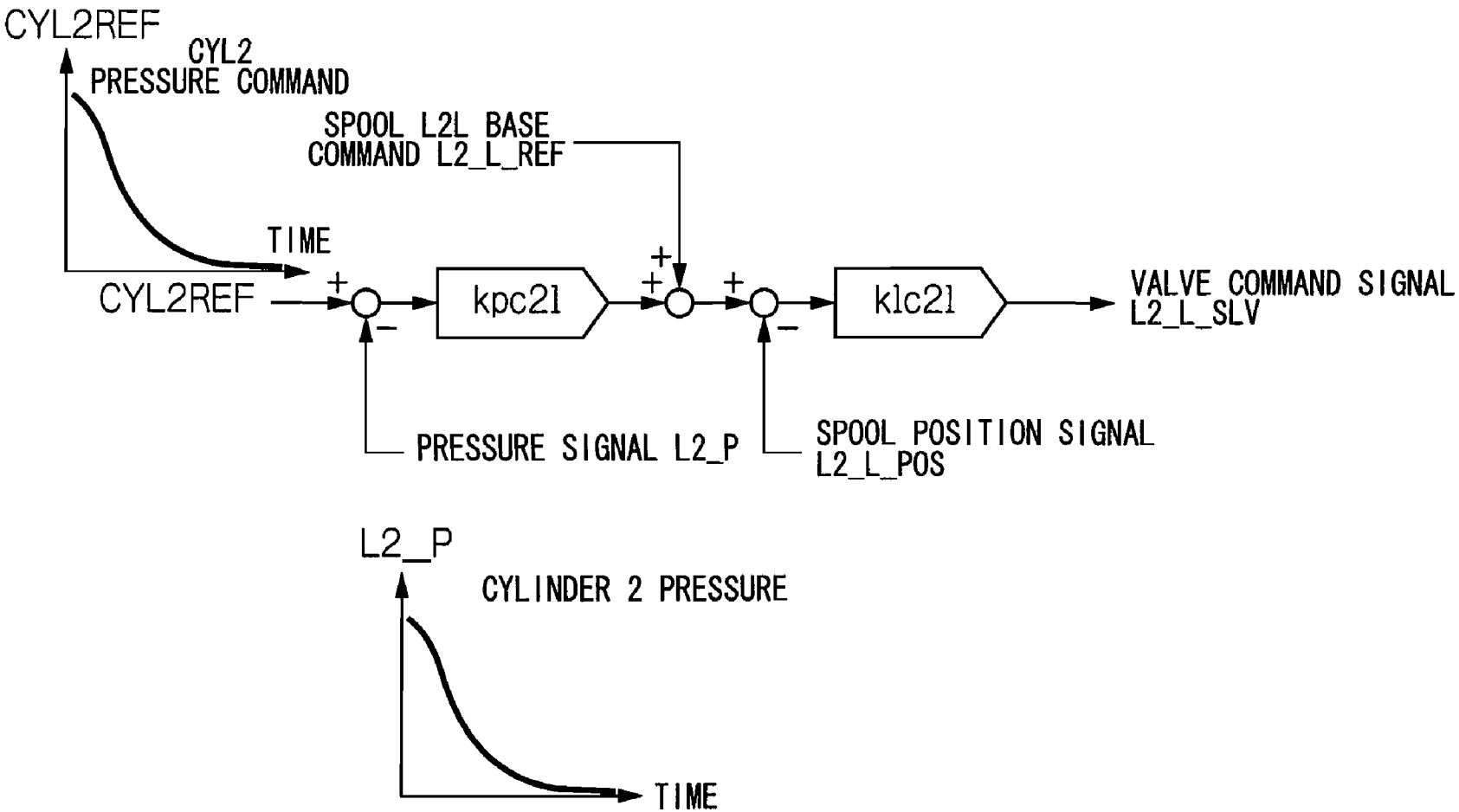
FIG. 12 is a circuit diagram illustrating a part of the hydraulic cylinder controller shown in FIG. 7 during the assist-off mode of the hydraulic cylinder.

FIG. 12 is a circuit diagram illustrating a part of the hydraulic cylinder controller 350 to output the valve command signal L2_L_SLV. As shown in FIG. 12, at the time of the decompression control upon assist, CYL2 pressure command upon decompression CYL2REF is output. The hydraulic cylinder controller 350 computes the spool position command of the valve V2_D_L, based on a deviation between the pressure command CYL2REF and the pressure signal L2_P detected by the pressure detector P_2_D, computes the valve command signal L2_L_SLV, based on a deviation between this spool position command and the spool position signal L2_L_POS detected by the spool position detector S2_D_L, and controls a spool position of the valve V2_D_L (opening) according to this valve command signal L2_L_SLV.

By controlling the valve V2_D_L with the valve command signal L2_L_SLV computed according to the decompression algorithm upon assist, the pressure of the hydraulic cylinder SYL2 will follow the pressure command CYL2REF.

Also, after decompression according to this decompression algorithm upon assist, the valve V2_D_L is controlled to have a constant flow rate for a steady-off state (almost full open opening). It is because, after completion of decompression process, the opening of the valve is enlarged so that oil flow is not throttled and energy efficiency is not lowered.

In addition, for the valves V1_D_H, V1_D_L, V2_D_H, V2_D_L controlled as described above, a valve is used which has opening and responsivity where change in pressure of at least not smaller than 50% of |P1−P0| can be achieved between two steady states (an almost constant, low pressure state (P0) and an almost constant, high pressure state (P1)) within 60 msec at the latest from the time at which a group of the valve command signals start to change.

In addition, the hydraulic cylinder controller 350 computes to output the valve command signal for operating the hydraulic cylinder SYL1 as a pump similarly as described above, upon receiving a during climb charge ON signal provided by the hydraulic charge controller 340.

Also, the hydraulic cylinder controller 350, when the hydraulic cylinders SYL1, SYL2 are driven, computes an adjustment signal (CYL1_ON adjustment signal, CYL2_ON adjustment signal) so as to compensate for a difference between thrust response proportion to predicted pressure response and predicted torque response of the electric motor, and outputs this adjustment signal to the composite motor controller 360.

Figure 13A:
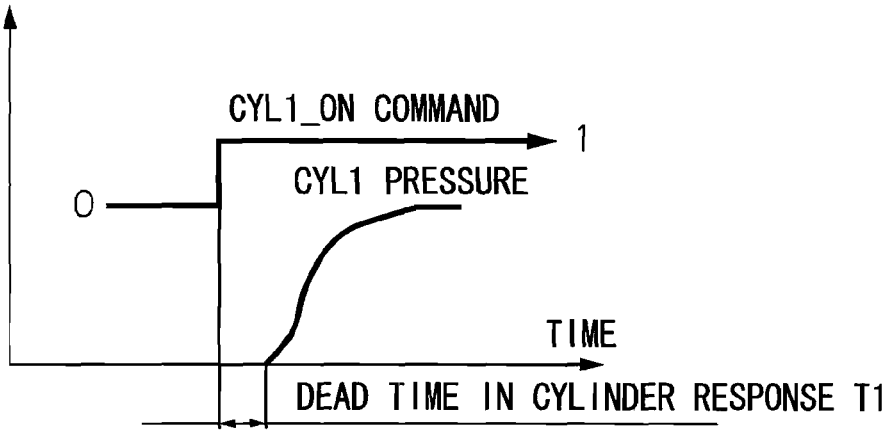
FIG. 13A is a graph illustrating pressure response of the hydraulic cylinder when CYL1_ON command for setting the hydraulic cylinder to the assist-on mode is given.
Figure 13B:
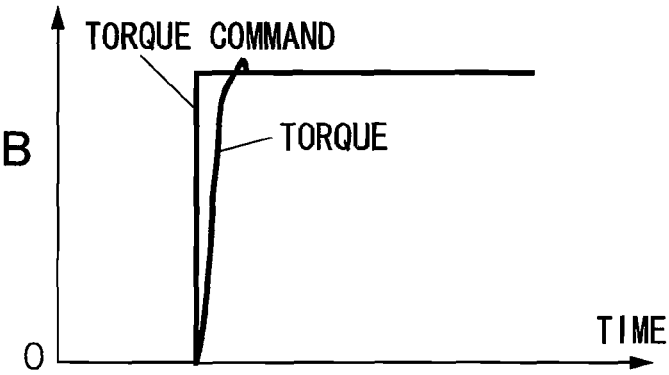
FIG. 13B is a graph illustrating torque response when a step-like torque command is given to the electric motor.

FIG. 13A is a graph illustrating pressure response of the hydraulic cylinder SYL1 when the CYL1_ON command for setting the hydraulic cylinder SYL1 to the assist-on mode is given, and FIG. 13B is a graph illustrating torque response when a step-like torque command is given to the electric motor SM.

Figure 14A:
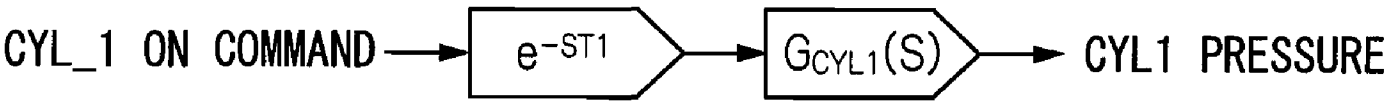
FIG. 14A is a view illustrating a transfer function from application of CYL1_ON command to pressure response of the hydraulic cylinder.
Figure 14B:
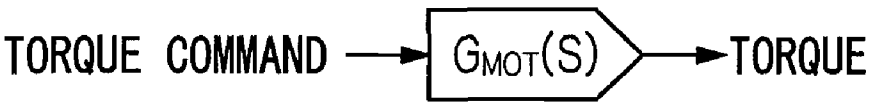
FIG. 14B is a view illustrating a transfer function from application of torque command to torque response of the electric motor.

FIG. 14A illustrates a transfer function from commanding of the CYL1_ON command to pressure response of the hydraulic cylinder SYL1. FIG. 14B illustrates a transfer function from commanding of the torque command to torque response of the electric motor SM.

Figure 15:
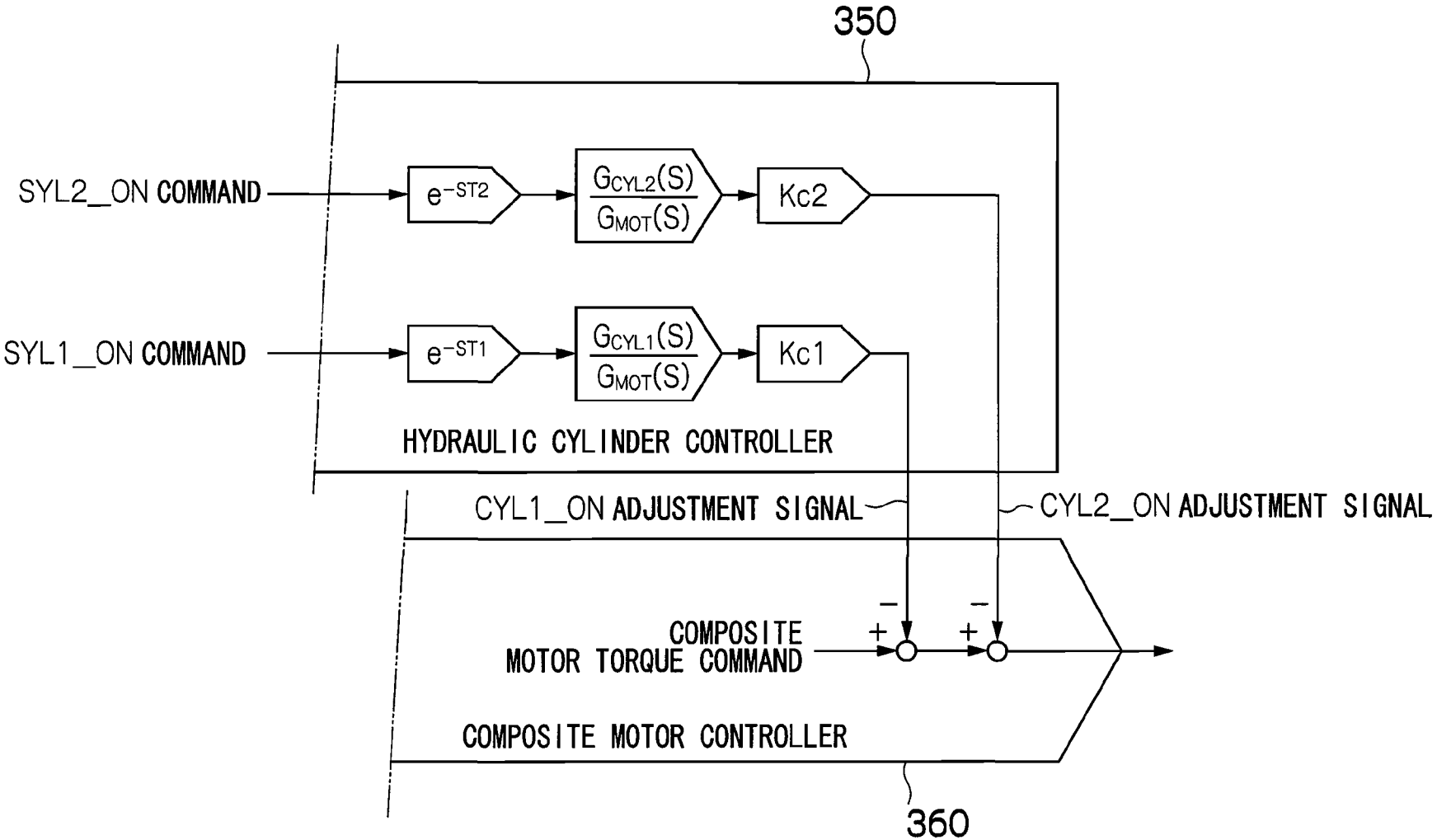
FIG. 15 is a view used for describing the hydraulic cylinder controller for computing CYL1_ON adjustment signal and CYL2_ON adjustment signal, and a composite motor controller for torque adjustment shown in FIG. 7.

The hydraulic cylinder controller 350 outputs the adjustment signal (CYL1_ON adjustment signal, CYL2_ON adjustment signal) corresponding to the cylinder thrust added to the slide 110 based on the CYL1_ON command or the CYL2_ON command, to the composite motor controller 360, with using the transfer functions shown in FIGS. 14A, 14B, as shown in FIG. 15, when the CYL1_ON command or the CYL2_ON command is generated. The composite motor controller 360 computes a motor torque command signal provided to the electric motor SM by subtracting the CYL1_ON adjustment signal and the CYL2_ON adjustment signal from the composite motor torque command signal, and this motor torque command signal is a matched signal even in a transition state.

Figure 16:
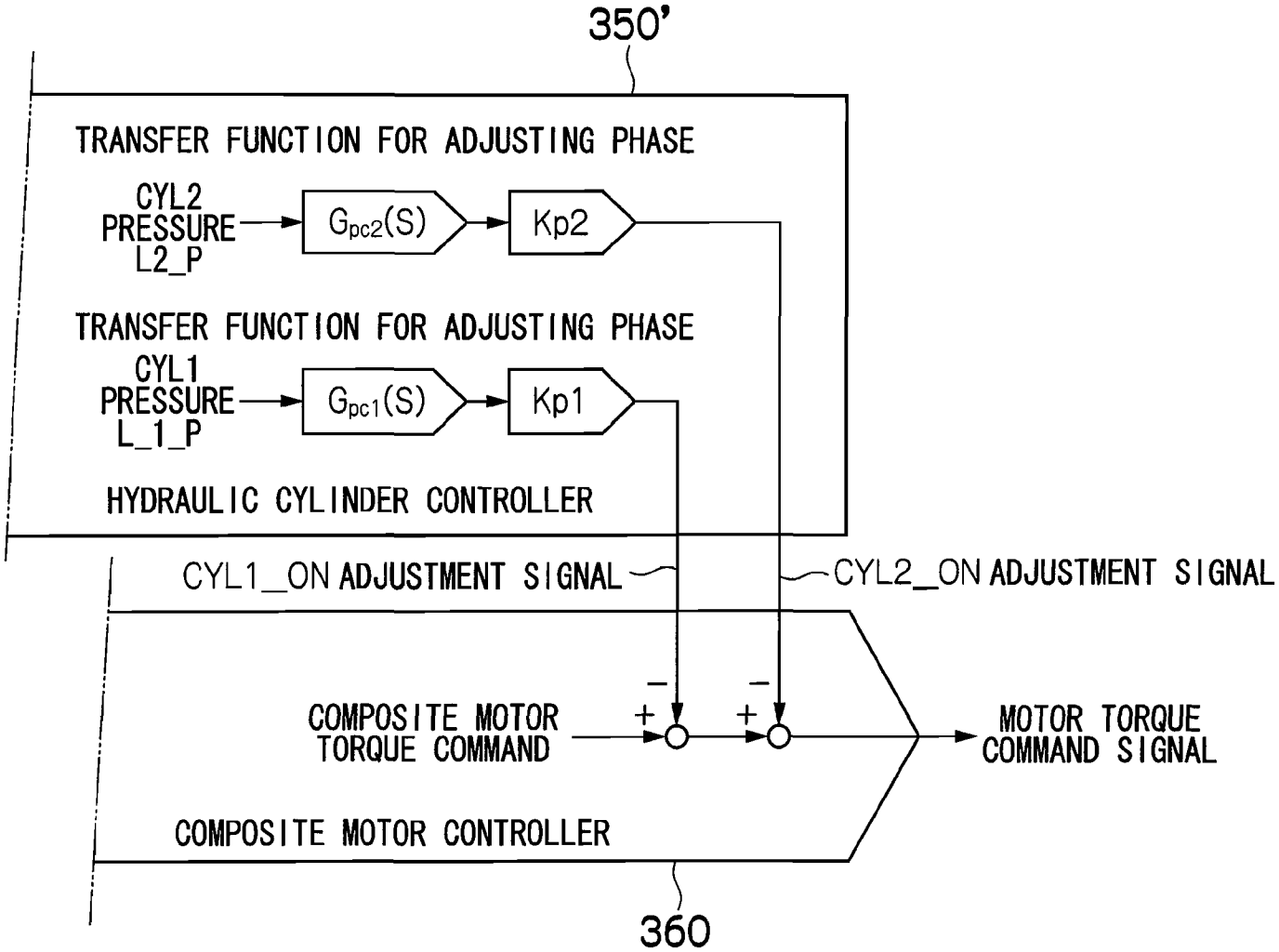
FIG. 16 is a view used for describing a hydraulic cylinder controller of another embodiment for computing CYL1_ON adjustment signal and CYL2_ON adjustment signal, and the composite motor controller for torque adjustment.

FIG. 16 shows another embodiment of a hydraulic cylinder controller for computing the CYL1_ON adjustment signal and the CYL2_ON adjustment signal to dynamically match in a simpler way.

A hydraulic cylinder controller 350' shown in FIG. 16, to subtract thrust corresponding to the cylinder thrust so as to match the pressure response of the hydraulic cylinders SYL1, SYL2 which is considerably slower than the torque response of the electric motor, outputs a signal formed by multiplying the pressure signals L1_P, L2_P (pressure response) indicating the pressure of the hydraulic cylinders SYL1, SYL2 by transfer functions GPC1(S), GPC2(S) for improving a response lag of the electric motor SM in phase, to the composite motor controller 360, as an adjustment signal (CYL1_ON adjustment signal, CYL2_ON adjustment signal).

Next, the composite motor controller 360 will be described.

As shown in FIG. 7, to the composite motor controller 360, the composite motor torque command signal is provided by the velocity controller 330, the disturbance torque estimation signal is provided by the disturbance torque estimator 370, the cylinder climb ON adjustment signal is applied by the pressure oil charge controller 340, and the SYL1_ON adjustment signal and the SYL2_ON adjustment signal are provided by the hydraulic cylinder controller 350.

The composite motor controller 360 forms the composite motor torque command signal having an effect of disturbance torque including press load, by adding the composite motor torque command signal and the disturbance torque estimation signal received together, subtracts the adjustment signals (CYL1_ON adjustment signal, CYL2_ON adjustment signal) from this composite motor torque command signal as shown in FIGS. 15, 16, and outputs the result of the subtraction as a motor torque command signal.

To the motor controller 380, the motor torque command signal is supplied by the composite motor controller 360, and the motor torque signal and the motor angular velocity signal are provided by the motor drive device 390. The motor controller 380 computes a motion drive signal from these signals and outputs this motor drive signal to the motor drive device 390. The motor angular velocity signal provided to the motor controller 380 in this example compensates for drop in motor torque caused due to drop of a command voltage generated by back electromotive force. That is, the motor angular velocity signal is used (added) in PWM of the command voltage in the motor controller 380 (pulse-width modulation control part) in order to compensate for a voltage corresponding to the back electromotive force generated proportionally to velocity. In addition, as the motor controller, various types are known and so it is not limited to this example.

The motor drive device 390 (FIG. 1) drives the electric motor SM, based on the motor drive signal provided by the slide control device 300.

Next, operation of the slide drive device of a press configured as described above will be described.

<State Waveform>

FIGS. 17 to 26 are graphs illustrating waveforms in various states (slide position, motor angular velocity, motor thrust (through speed reducer, screw and nut mechanism), each hydraulic cylinder pressure, each hydraulic cylinder thrust, oil flow rate of constant, high pressure source flowing into/out of each hydraulic cylinder, pressure of constant, high pressure source, amount of oil in constant, high pressure source, press load and slide acceleration command) in one cycle, when the slide 110 is driven, respectively.

Figure 17:
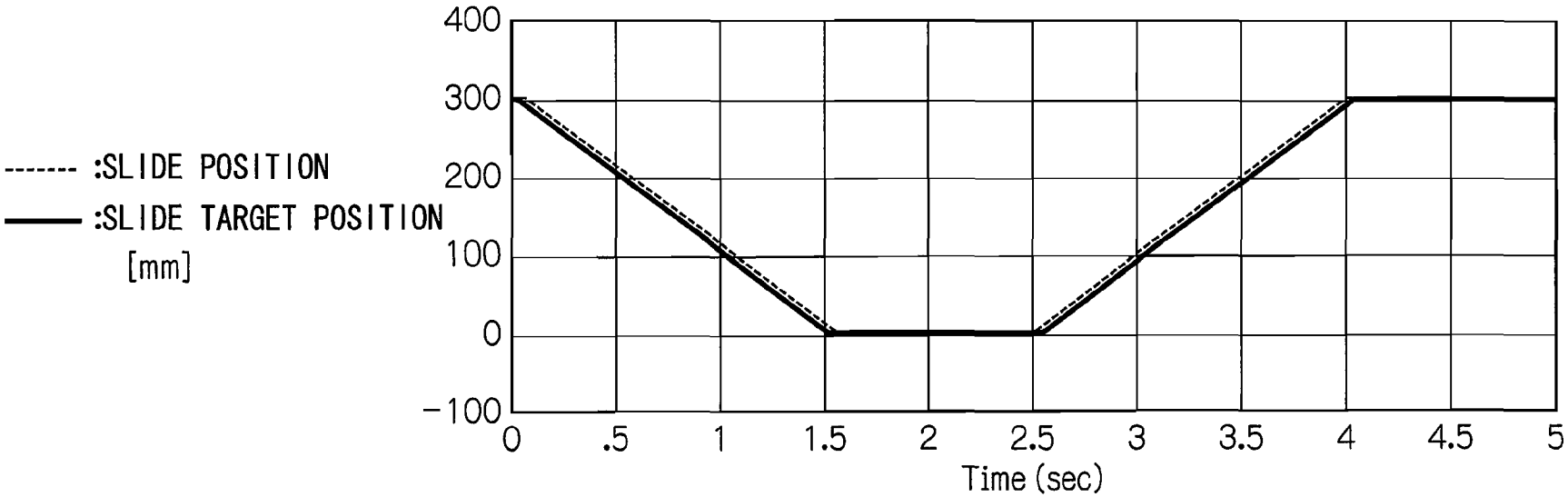
FIG. 17 is a graph illustrating a slide target position and a slide position in one cycle.

A solid line and a dotted line in FIG. 17 denote the slide target position command and the slide position, respectively. An upper limit position command of the slide target position command is 300 mm, and a lower limit position command is 0 mm (the upward direction is defined as the positive direction). The slide target position command as described in FIG. 8 is created by time-integrating the slide velocity command by the integrator 323 in the slide position controller 320, and in this embodiment, the slide velocity command of 200 mm/sec is time-integrated.

<Before Slide Operation=During Slide Operation Stop>

At the start of operation of the press machine 100 (before operation), pressure oil for driving the cylinder is not accumulated in the constant, high pressure source 204. The slide overall controller 310 of the slide control device 300 (FIG. 7) detects that the pressure of the pressure oil is not larger than a storage lower limit set pressure during operation stop (for example, 21 MPa), based on the almost constant, high pressure signal provided by the pressure detector P_H, outputting the pressure oil supply signal to the auxiliary pressure oil supply device 230. The auxiliary pressure oil supply device 230, upon receiving the pressure oil supply signal, charges pressure oil to the constant, high pressure source 204 to secure initial pressure oil in the constant, high pressure source 204.

Figure 23:
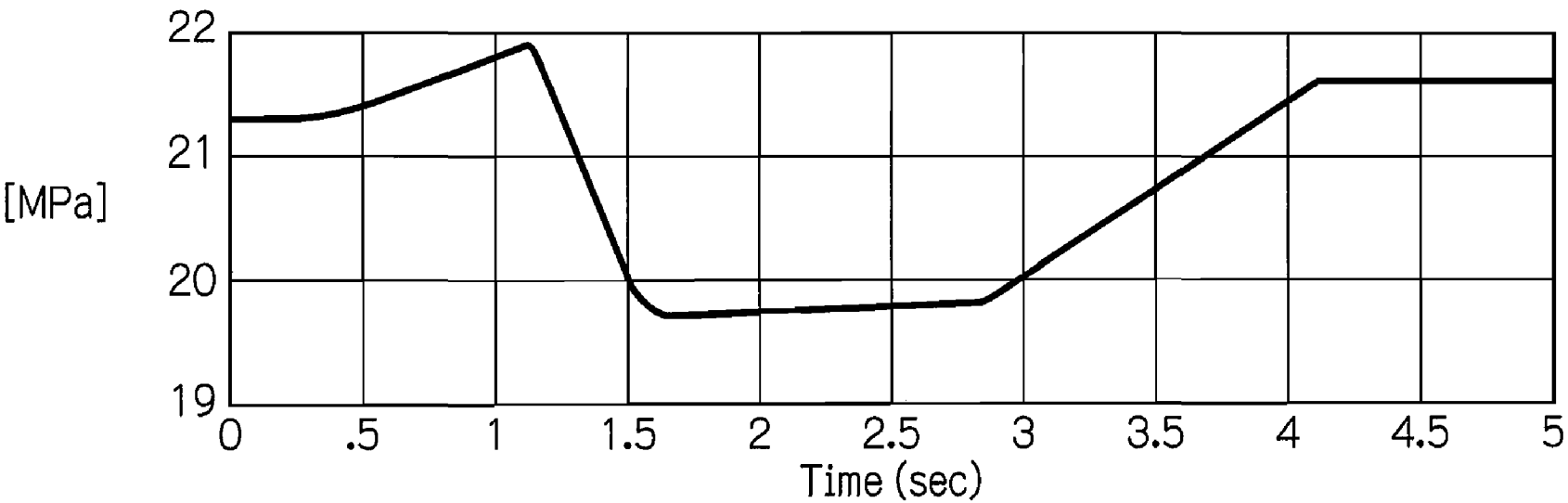
FIG. 23 is a graph illustrating pressure of a constant, high pressure source in one cycle.

FIG. 23 shows the pressure of the constant, high pressure source 204, the pressure at the time 0 sec is a pressure of pressure oil charged by the auxiliary pressure oil supply device 230 before operation.

<Slide Descent Start, Downward Acceleration→Constant Velocity (Uniform Motion), the Period from 0 to 1.15 Sec in the Waveform Chart>

The brake OFF signals B1, B2 are output to the gravity fall-preventing device 250 by the slide overall controller 310 of the slide control device 300, the gravity fall function of the slide 110 during operation stop (brake function) is released.

Figure 26:
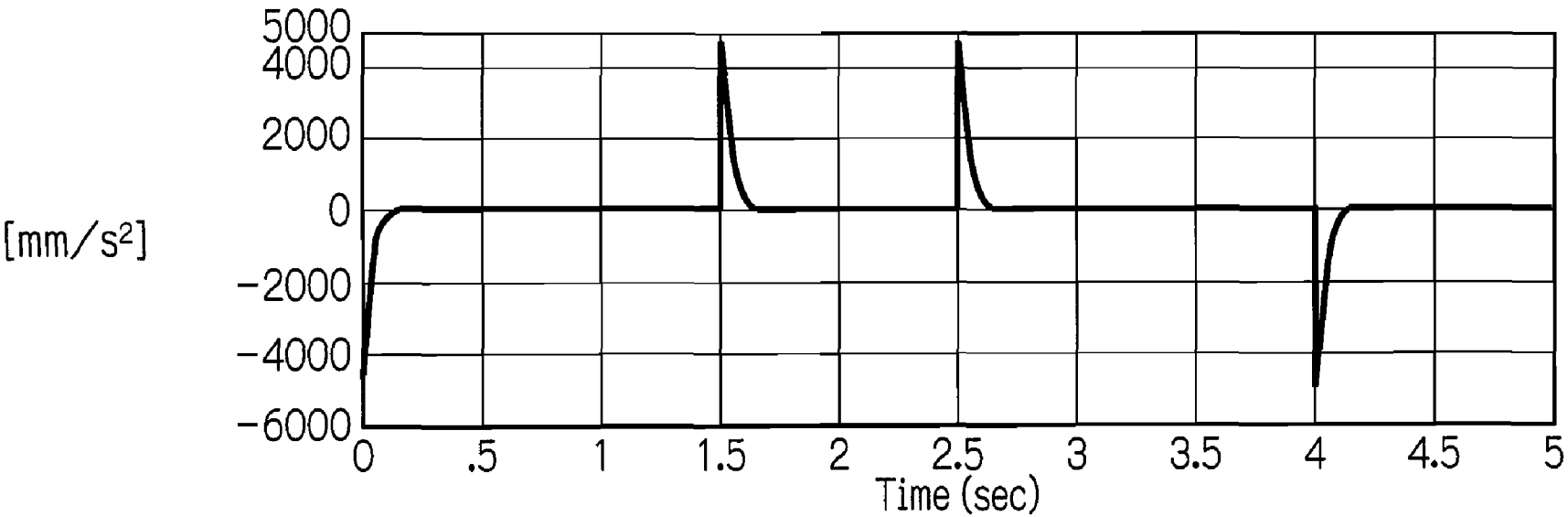
FIG. 26 is a graph illustrating a slide acceleration command in one cycle.

On the one hand, the integrator 322 (FIG. 8) of the slide position controller 320 computes a slide acceleration command. FIG. 26 shows the slide acceleration command. The charge signal generator 324 determines the time at which a slide acceleration region requiring a comparatively large torque is passed through according to the slide acceleration command (the time at which an absolute value of negative torque in the vicinity of 0 sec shown in FIG. 26 becomes small), outputting the charge base signal to the charge drive device 270.

The pressure oil charge controller 340, upon receiving the charge base signal, until a signal indicating that the hydraulic cylinder SYL1 is driven for assist is applied, outputs a valve command for charge signal to turn on the charge valve 273 in the charge drive device 270. The charge drive device 270 (FIG. 6), upon receiving the valve command for charge signal, turns on the charge valve 273 to block the pipe line T on the low pressure side by the pilot operated check valve 272, and charges pressure oil discharged from the cylinder lower rooms of the hydraulic cylinders SYL1*a*, SYL1*b* during descent of the slide 110 to the constant, high pressure source 204 through the pipe line P on the high pressure side via the check valve 271.

Figure 24:
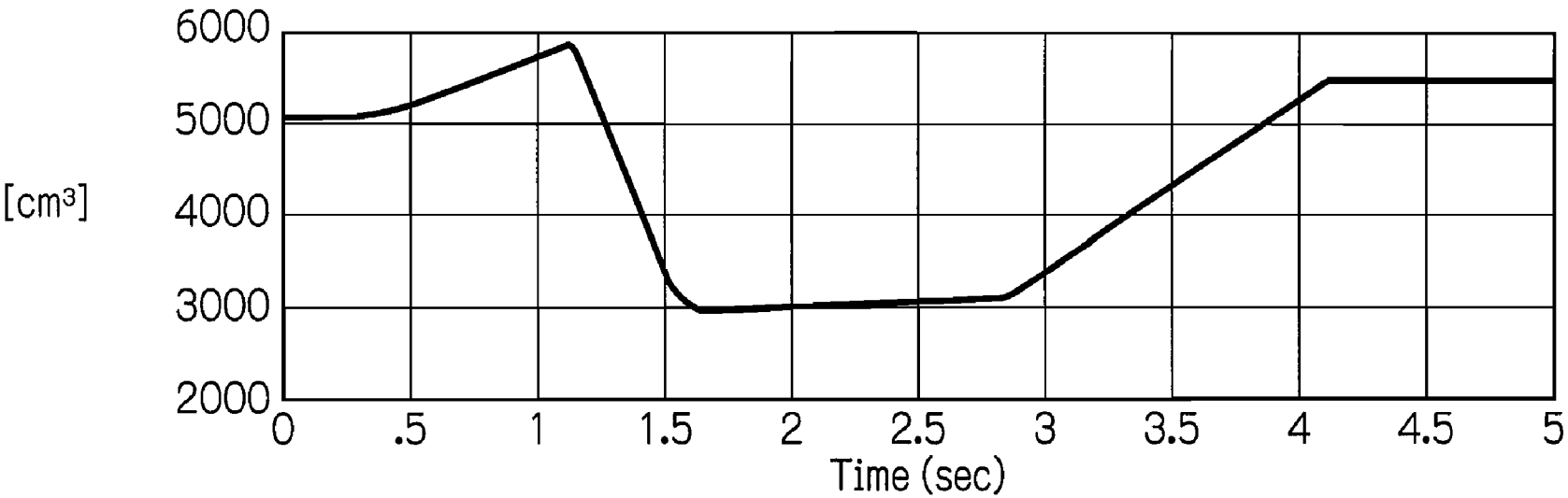
FIG. 24 is a graph illustrating oil flow of the constant, high pressure source in one cycle.

FIGS. 23, 24 shows pressure and flow rate of pressure oil in the constant, high pressure source 204, respectively, and a pressure rising part and flow rate rising part between the times of 0.4 sec and 1.15 sec shown in FIGS. 23, 24 are formed according to charge during descent.

<Later Half of Slide Descent, Forming Force Load, Assist Operation, Stop at Bottom Dead Point, the Period Between 1.1 Sec and 2.5 Sec in the Waveform Chart>

Figure 25:
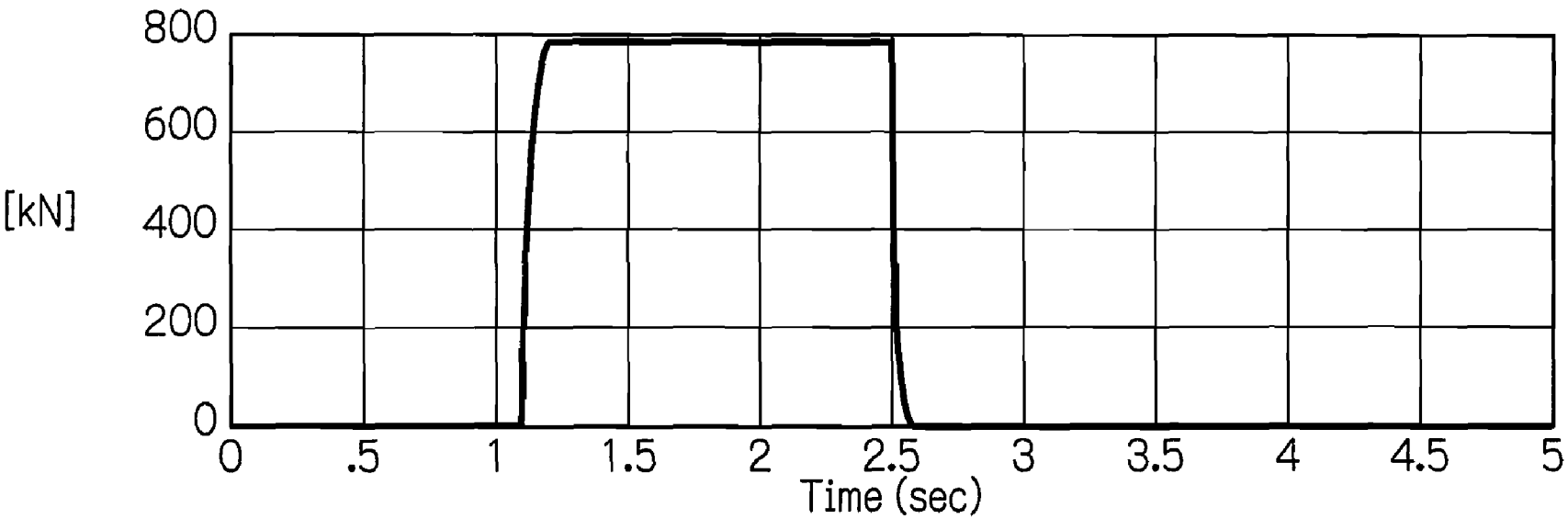
FIG. 25 is a graph illustrating press load in one cycle.

Forming force shown in FIG. 25 acts during a period from the slide position of 100 mm (after an elapse of 1.1 sec) to a slide bottom dead point (0 mm).

Figure 18:
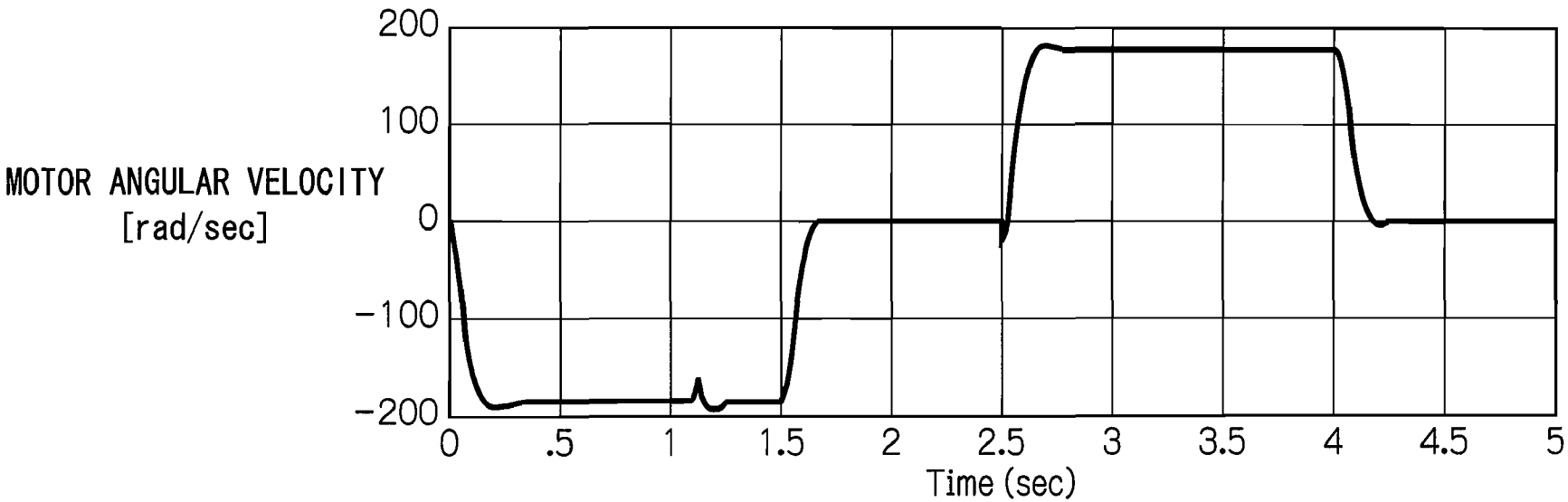
FIG. 18 is a graph illustrating a motor angular velocity of the electric motor in one cycle.
Figure 19:
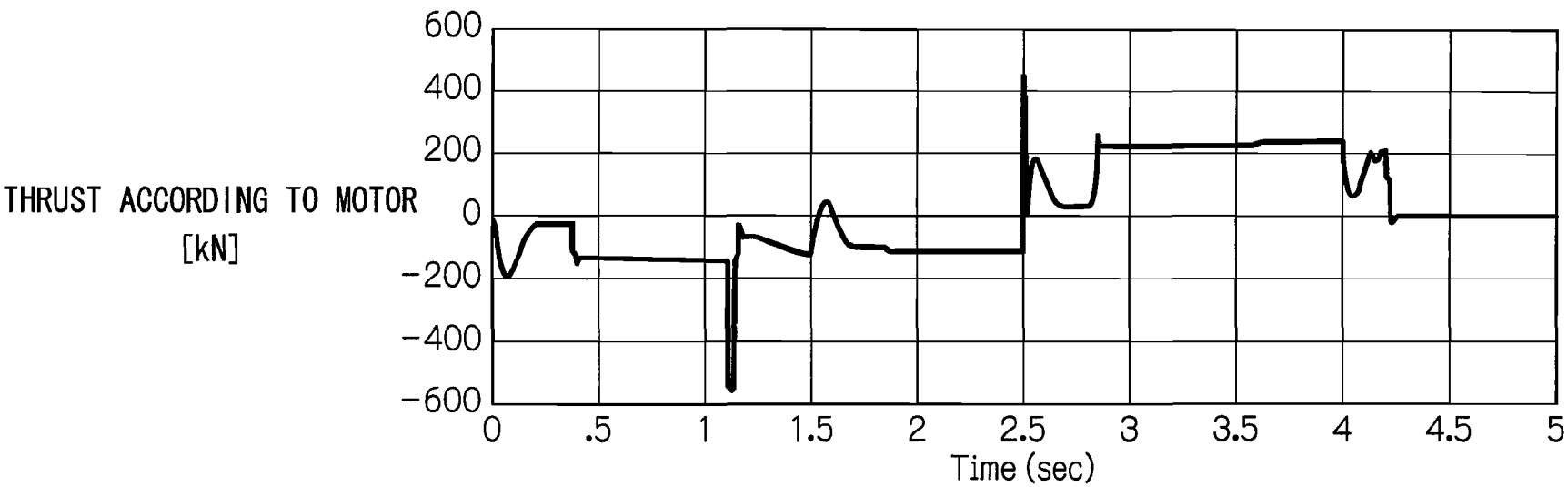
FIG. 19 is a graph illustrating thrust of the electric motor in one cycle.
Figure 20:
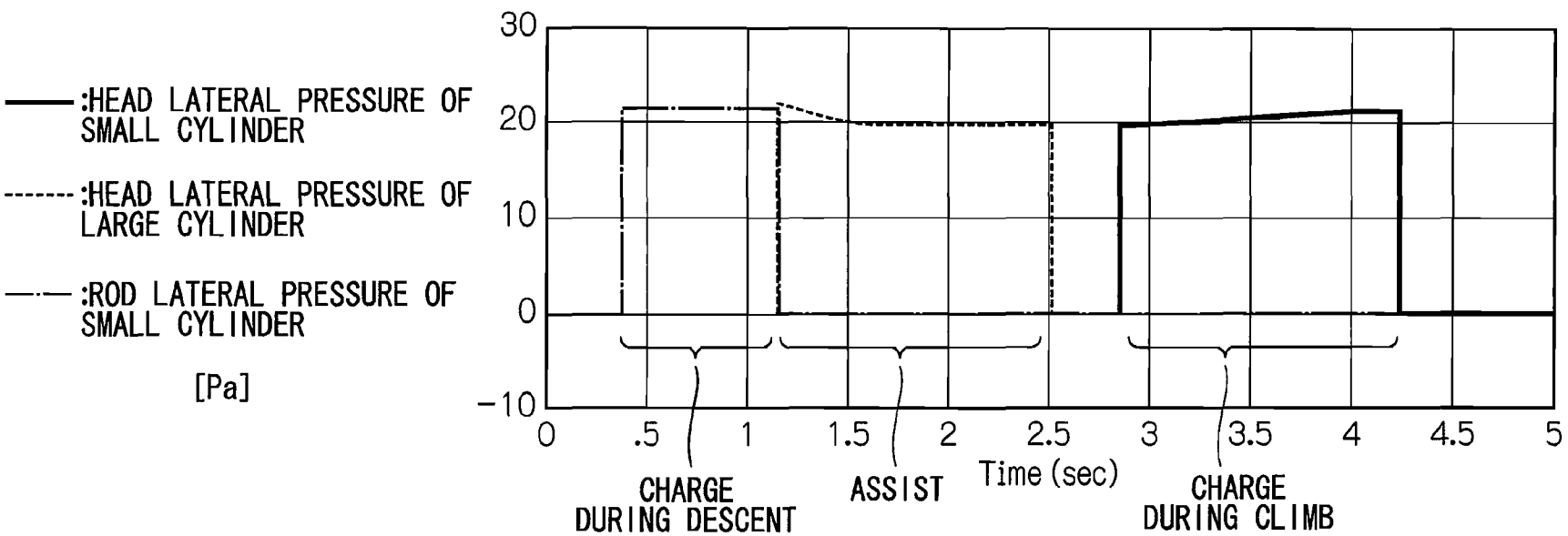
FIG. 20 is a graph illustrating head lateral pressure of the small hydraulic cylinder, lateral pressure at a rod thereof, and head lateral pressure of the large hydraulic cylinder in one cycle.
Figure 21:
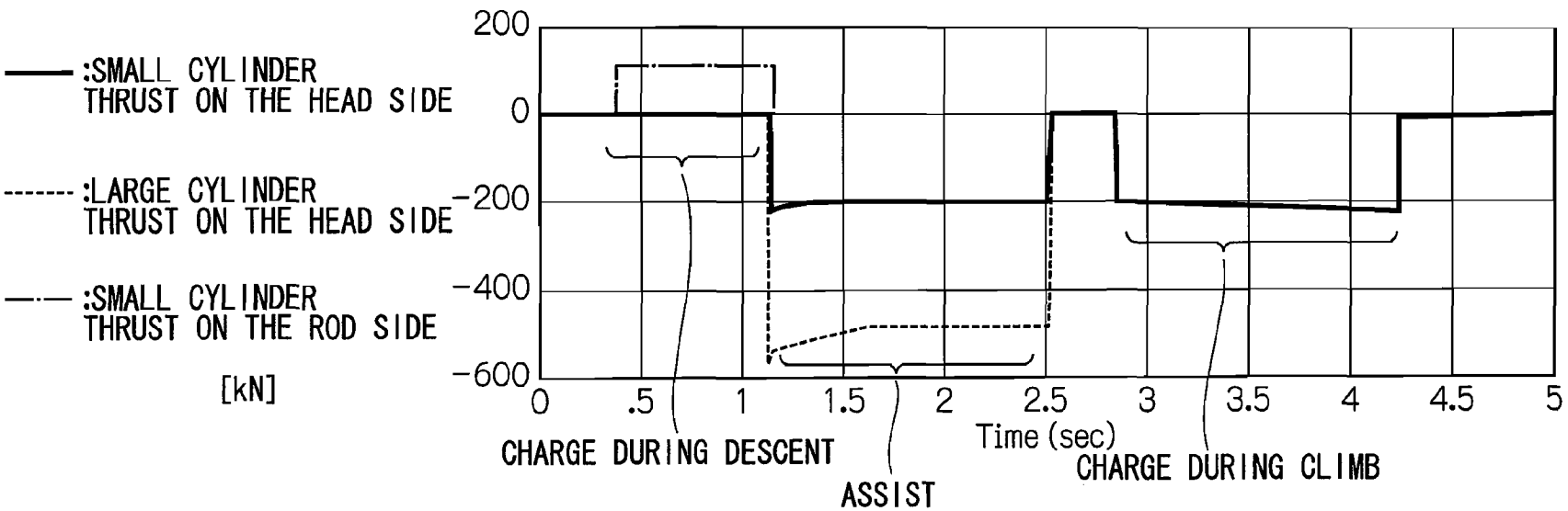
FIG. 21 is a graph illustrating thrust on the head side of the small hydraulic cylinder, thrust on the side of the rod thereof, and thrust on the side of the head of the large hydraulic cylinder in one cycle.
Figure 22:
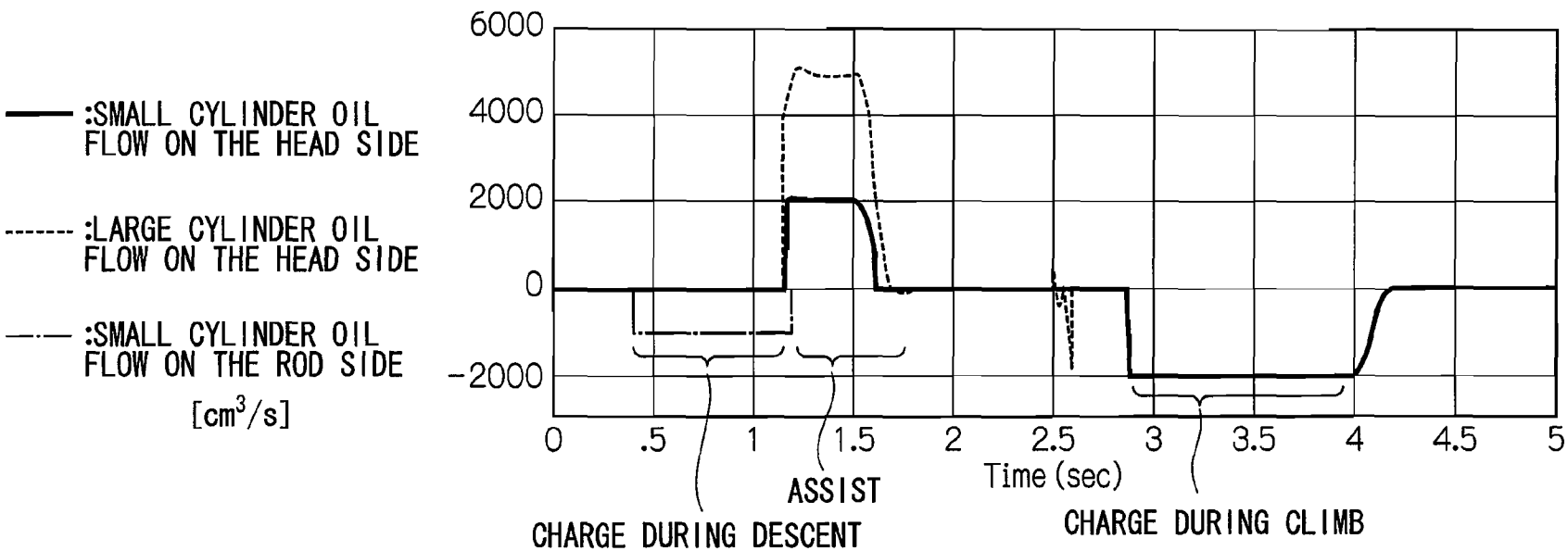
FIG. 22 is a graph illustrating oil flow on the head side of the small hydraulic cylinder, oil flow on the side of the rod thereof, and oil flow on the side of the head of the large hydraulic cylinder in one cycle.

FIG. 18 shows the motor angular velocity (drive shaft angular velocity) of the electric motor SM. It is seen that, except a transition period during which the forming force (press load) acts, a stable velocity curve is exhibited independent of load operation. It largely results from offsetting the disturbance torque by computing to estimate disturbance torque including the press load etc. using the disturbance torque estimator 370 in the slide control device 300, based on the velocity signal etc., and outputting the result of the estimation to the composite motor controller 360.

When the forming force acts, the hydraulic cylinder controller 350, based on the motion base signal for controlling position and velocity, and the disturbance torque estimation signal (the sum total of these (determined amount of assist)), outputs a group of the valve command signals to drive the hydraulic cylinder SYL1 (small cylinder) or the hydraulic cylinder SYL2 (large cylinder) according to magnitude of the signals above, compensating for lack of the thrust of the electric motor SM (via the screw/nut mechanism) using the cylinder thrust.

The hydraulic cylinder controller 350, when driving the hydraulic cylinder CYL1 or CYL2, outputs, to the composite motor controller 360, the adjustment signals (CYL1_ON adjustment signal, CYL2_ON adjustment signal) to compensate for a difference between thrust response proportional to predicted pressure response and predicted torque response of the electric motor SM, and the composite motor controller 360 smoothly combines the thrust of the electric motor SM via the screw/nut mechanism and the hydraulic cylinder thrust even in a dynamic manner (in a transition state of composition), by adding the adjustment signals to the composite motor torque command signal.

Further, at this time, pressure oil is consumed for formation, and when the almost constant, high pressure signal becomes not greater than the storage lower limit set pressure during operation (for example, 21 MPa), the auxiliary pressure oil supply device 230 starts to operate to accumulate pressure oil in the constant, high pressure source 204. In addition, during operation of the press machine 100, upon reaching a predetermined pressure (storage upper limit set pressure during operation (for example, 22.5 MPa), supply of pressure oil by the auxiliary pressure oil supply device 230 is stopped.

<Initial Period of Slide Climb (Acceleration), Unloading of Forming Force, Assist Release, the Period from 2.5 to 2.8 Sec in the Waveform Chart>

Similarly to the descent, as shown in FIG. 17, the slide 110 is controlled so that the slide position follows the slide target position command created by the slide position controller 320 based on the slide control device 300.

At this time, the forming force is released at an initial start period of climb, and the motion base signal for controlling position and velocity, and the disturbance torque estimation signal (the sum total of these (determined amount of assist)) become small, so that the hydraulic cylinder controller 350 outputs a group of the valve command signals to set the hydraulic cylinder SYL1 (small cylinder) and the hydraulic cylinder SYL2 (large cylinder) to the assist-off mode in turn.

Also, when the hydraulic cylinder controller 350 sets the hydraulic cylinder CYL1 or CYL2 to the assist-off mode, similarly to the assist-on mode, it outputs the adjustment signals to the composite motor controller 360, and the composite motor controller 360 smoothly combines the thrust of the electric motor SM via the screw/nut mechanism and the hydraulic cylinder thrust even in a dynamic manner (even in a transition state of composition), by adding the adjustment signals to the composite motor torque command signal.

<Middle Period of Slide Climb (Uniform Motion), Pressure Oil Charge During Climb, the Period Between 2.8 Sec and 4.0 Sec in the Waveform Chart>

Similarly to during slide descent, the integrator 322 (FIG. 8) of the slide position controller 320 computes the slide acceleration signal, and the charge signal generator 324 determines the time at which the slide acceleration region during climb requiring a comparatively large torque is passed through (the time at which an absolute value of positive torque in the vicinity of 2.5 sec shown in FIG. 26 becomes small) according to the slide acceleration command, outputting the charge base signal to the charge drive device 270.

The pressure oil charge controller 340, upon receiving the charge base signal, outputs the charge ON during climb signal to the hydraulic cylinder controller 350, during process of slide climb. The hydraulic cylinder controller 350, upon receiving the charge ON during climb signal, to drive the hydraulic cylinder SYL1, outputs a group of the valve command signals, driving the hydraulic cylinder SYL1, and the pressure, similarly to during assist, is controlled based on preset responsivity.

At this time, the thrust of the hydraulic cylinder SYL1 is directed downward and opposite to the direction of operation of the electric motor SM, and so the electric motor SM bears an extra torque corresponding to the thrust of the hydraulic cylinder SYL1. A motor torque command for the increment corresponding to this thrust of the hydraulic cylinder SYL1, similarly to during assist operation, is computed, based on the CYL1_ON adjustment signal or the disturbance torque estimation signal. In short, the hydraulic cylinder SYL1 performs a pump operation and pressure oil is charged from the low pressure source 208 to the constant, high pressure source 204 with the extra power of the electric motor during climb of the slide. In addition, charge during climb, at a predetermined time of climb start, is allowed only when the almost constant, high pressure signal is not greater than a set pressure for charge actuation during climb (for example, 21.8 MPa).

<Latter Period of Slide Climb (Deceleration), Recovery of Energy During Braking, the Period Between 4.0 Sec and 4.2 Sec in the Waveform Chart>

The slide 110 is controlled by the slide control device 330 so that the slide position follows the slide target position command, and as the result, the slide, coming close to a top dead point, is decelerated. At this time, the torque of the electric motor SM is generated intrinsically on the deceleration side (on the descent side), but because the hydraulic cylinder SYL1 is (continuously) driven as a pump for charge during climb (the thrust is generated on the descent side), the thrust is generated on the acceleration side (on the climb side). That is, braking force is formed by subtracting force on the climb side applied by the electric motor (+the screw mechanism) from force on the descent side applied by the hydraulic cylinder SYL1 in pump operation (charge of pressure oil) from the low pressure source 208 to the constant, high pressure source 204, finally, pressure oil is charged by kinetic energy which the slide 110 has and the power on the climb side of the electric motor SM, and at least all the kinetic energy which the slide 110 has is recovered, as pressure oil, into the constant, high pressure source 208.

Figure 27:
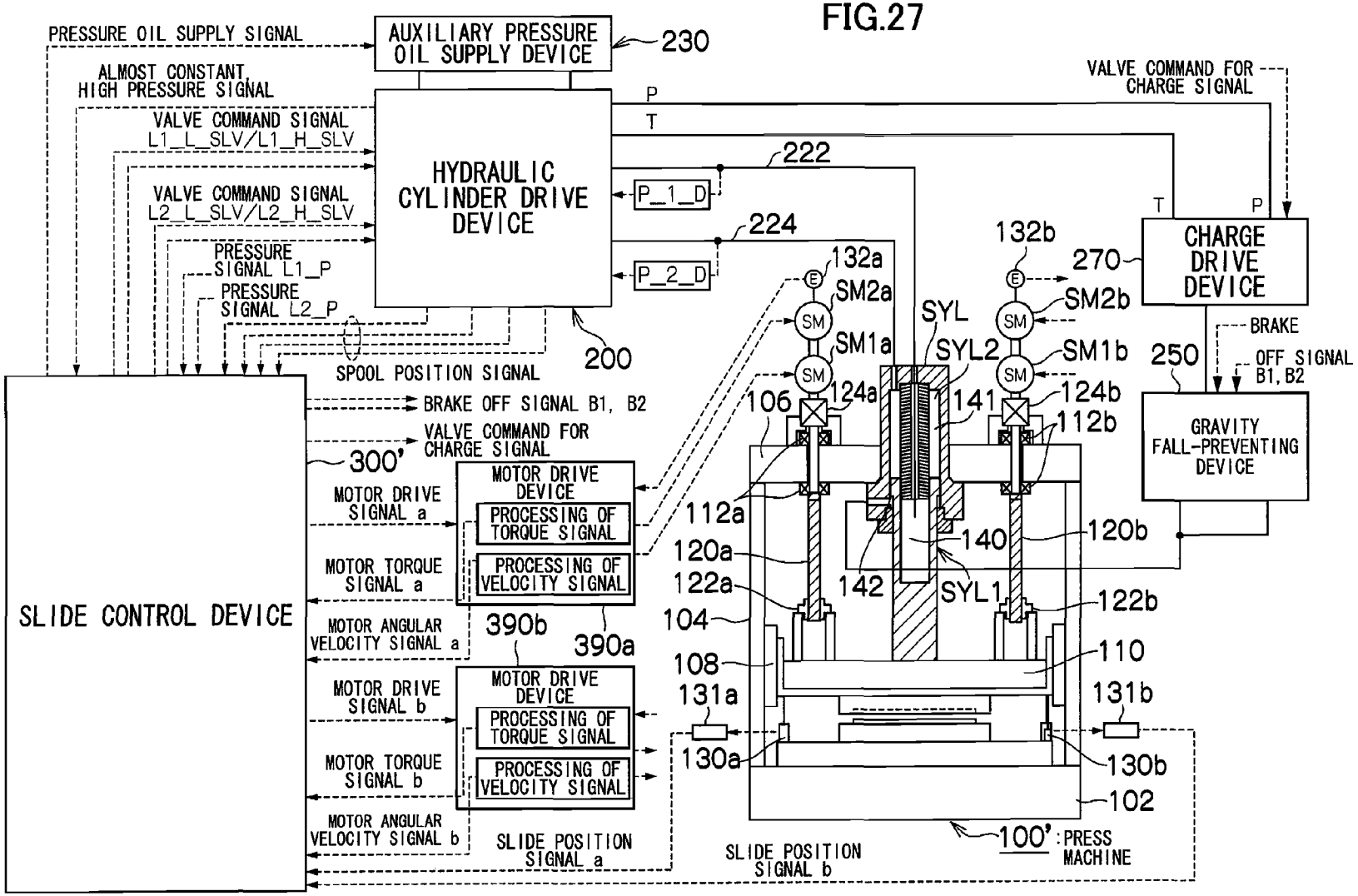
FIG. 27 is a schematic view illustrating an overall configuration of another embodiment of a slide drive device of a press machine according to the present invention.

FIG. 27 is a schematic view illustrating an overall configuration of another embodiment of a slide drive device of a press according to the present invention. In addition, a part common to the embodiment shown in FIG. 1 and this embodiment is denoted by like symbol and detailed description thereof will be omitted.

The slide drive device of a press machine of the embodiment shown in FIG. 27 is mainly different from that of the embodiment of FIG. 1 with respect to press machine 100' and slide control device 300'.

The press machine 100' has a frame including a bed 102, a column 104 and a crown 106, and a slide (movable platen) 110 is movably guided vertically by a guide part 108 provided in the column 104.

As drive device for driving the slide 110, a dual hydraulic cylinder SYL, and a pair of screw/nut mechanisms for transferring output torque of electric motors SM1*a*, SM2*a*, SM1*b*, SM2*b* are provided.

The dual hydraulic cylinder SYL includes a hydraulic cylinder SYL1 including an oil sac 140 with a small pressure receiving area, and a hydraulic cylinder SYL2 including oil sacs 141, 142 with a large pressure receiving area, and a cylinder body of this dual hydraulic cylinder SYL is fixed on the crown 106, a piston rod is fixed on the slide 110, and, thrust can be transferred to the slide 110 entirely across a stroke of the slide 110. In addition, the oil sacs 140, 141 are connected to pipe lines 222, 224, respectively, and the oil sac 142 is connected to a gravity fall-preventing device 250.

The pair of screw/nut mechanisms include drive screws 120*a*, 120*b* rotatably fixed on the crown 106 through bearings 112*a*, 112*b*, respectively, and driven nuts 122*a*, 122*b* fixed to the slide 110 and engaging with the drive screws 120*a*, 120*b*, and to the drive screws 120*a*, 120*b*, output torque of the electric motors SM1*a*, SM2*a*, SM1*b*, SM2*b* is transferred through speed reducers 124*a*, 124*b*. In addition, the pair of screw/nut mechanisms is disposed at a position symmetrical about the center of the slide 110, respectively.

Further, on the side of the base 102' of the press machine 100', slide position detectors 130*a*, 130*b* for detecting a right position and a left position of the slide 110, respectively, are provided, and in the electric motors SM1*a*, SM2*a*, and the electric motors SM1*b*, SM2*b*, drive shaft angular velocity detectors 132*a*, 132*b* for detecting an angular velocity of each drive shaft are provided.

The slide position detectors 130*a*, 130*b* output slide position signals (a), (b) indicating the right and left slide position of the slide 110 to the slide control device 300' through position signal process devices 131*a*, 131*b*, and the drive shaft angular velocity detectors 132*a*, 132*b* output angular velocity signals (motor angular velocity signals (a), (b)) of each drive shaft to the slide control device 300' through motor drive devices 390*a*, 390*b*. Further, the motor drive devices 390*a*, 390*b* output motor torque signals (a), (b) to the slide control device 300'.

Next, the slide control device 300' shown in FIG. 27 will be described with reference to FIG. 28. In addition, a part common to this and the slide control device 300 shown in FIG. 7 is denoted by like symbol, and its detailed description will be omitted.

As shown in FIG. 28, the slide control device 300' includes a slide overall controller 310, a slide position controller 320', a velocity controller 330', a pressure oil charge controller 340, a hydraulic cylinder controller 350, a composite motor controller 360', disturbance torque estimators 370*a*, 370*b*, and motor controllers 380*a*, 380*b*.

The slide position controller 320' has a similar configuration to the slide position controller 320 shown in FIG. 8, but because it receives the slide position signals (a), (b) indicating the right and left position of the slide 110 provided by the slide position detectors 130*a*, 130*b* through the position signal process devices 131*a*, 131*b*, it computes to output right and left velocity command signals (a), (b) of the slide 110, respectively. Further, this slide position controller 320' does not output a charge base signal, and so, an acceleration computing unit 326, which receives the motor angular velocity signals (a), (b), outputs the charge base signal to the pressure oil charge controller 340. This acceleration computing unit 326 computes an average acceleration of right and left accelerations of the slide 110 from the motor angular velocity signals (a), (b), and creates to output the charge base signal to the pressure oil charge controller 340, based on the acceleration.

To the velocity controller 330', velocity command signals (a), (b) and the motor angular velocity signals (a), (b) are provided, and the velocity controller 330' computes a motion base signal and composite motor torque command signals (a), (b) for controlling position and velocity, based on these signals. The motion base signal is provided to the hydraulic cylinder controller 350, and the composite motor torque command signals (a), (b) are provided to the composite motor controller 360' and the disturbance torque estimators 370*a*, 370*b*.

To the disturbance torque estimator 370*a*, besides the composite motor torque command signal (a), a motor torque signal (actual current signal) (a) and the motor angular velocity signal (a) are provided, and the disturbance torque estimator 370*a* computes to estimate disturbance torque including press load etc., based on the motor angular velocity signal (a) etc. Similarly, to the disturbance torque estimator 370*b*, besides the composite motor torque command signal (b), a motor torque signal (actual current signal) (b) and the motor angular velocity signal (b) are provided, and the disturbance torque estimator 370*b* computes to estimate disturbance torque including press load etc., based on the motor angular velocity signal (b) etc. These disturbance torque estimators 370*a*, 370*b* output disturbance torque estimation signals (a), (b) respectively computed to the hydraulic cylinder controller 350 and the composite motor controller 360'.

The composite motor controller 360' computes to obtain a composite motor torque command signal including an effect of disturbance torque including press load etc., by summing the composite motor torque command signal (a) and the disturbance torque estimation signal (a) provided, and subtracts an adjustment signal (CYL1_ON adjustment signal, CYL2_ON adjustment signal) from this composite motor torque command signal, and outputs the result of the subtraction as a motor torque command signal (a), and at the same time, the composite motor controller 360' computes to obtain a composite motor torque command signal by summing the composite motor torque command signal (b) and the disturbance torque estimation signal (b) provided, and subtracts an adjustment signal from this composite motor torque command signal, and outputs the result of the subtraction as a motor torque command signal (b).

To the motor controllers 380*a*, 380*b*, the motor torque command signals (a), (b) are provided by the composite motor controller 360, respectively, and the motor torque signals (a), (b), and the motor angular velocity signals (a), (b) are provided by the motor drive devices 390*a*, 390*b*. The motor controllers 380*a*, 380*b* compute motor drive signals (a), (b) from these signals, and output these motor drive signals (a), (b) to the motor drive devices 390*a*, 390*b*. The motor drive devices 390*a*, 390*b* (FIG. 27) drive the electric motors SM1*a*, SM2*a* and the electric motors SM1*b*, SM2*b*, based on the motor drive signals (a), (b) provided by the slide control device 300'.

That is, the slide control device of a press machine of the this embodiment drives the electric motors SM1*a*, SM2*a* and the electric motors SM1*b*, SM2*b*, respectively, and so it can apply thrust to the right side and the left side of the slide 110, respectively, via the pair of right and left screw/nut mechanisms. Accordingly, even when eccentric press load is applied to the slide 110, thrust corresponding to the eccentric press load can be applied, maintaining parallelism of the slide 110 to be highly accurate.

Figure 29:
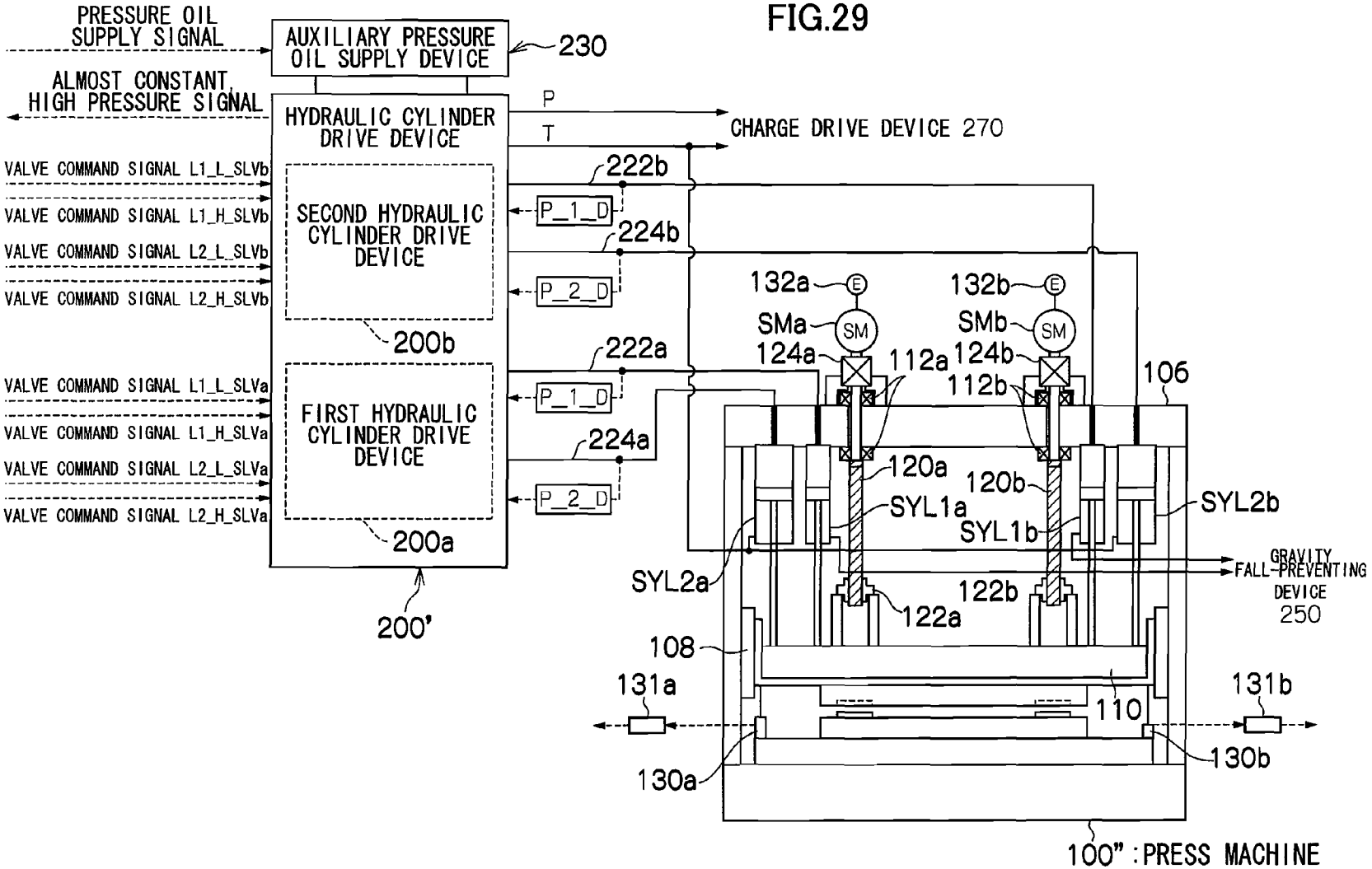
FIG. 29 is a schematic view illustrating a configuration of a main part of yet another embodiment of a slide drive device of a press machine according to the present invention.

FIG. 29 is a schematic view illustrating a configuration of a main part of yet another embodiment of a slide drive device of a press machine according to the present invention. In addition, a part common to this embodiment, the embodiment shown in FIG. 1 and the embodiment shown in FIG. 27 is denoted by like symbol and detailed description thereof will be omitted.

The slide drive device of a press machine of the embodiment shown in FIG. 29 is mainly different from those of the embodiments shown in FIGS. 1, 27 with respect to press machine 100" and a hydraulic cylinder drive device 200'.

The press machine 100", similarly to the press machine 100 shown in FIG. 1, includes two large and small hydraulic cylinders SYL1 (SYL1*a*, SYL1*b*), SYL2 (SYL2*a*, SYL2*b*), and further, similarly to the press machine 100' shown in FIG. 27, includes a pair of screw/nut mechanisms for transferring output torque of an electric motor.

In addition, electric motors SMa, SMb for driving the screw/nut mechanisms are respectively driven and controlled by a slide control device similar to the slide control device 300' of the embodiment shown in FIG. 28.

Figure 5:
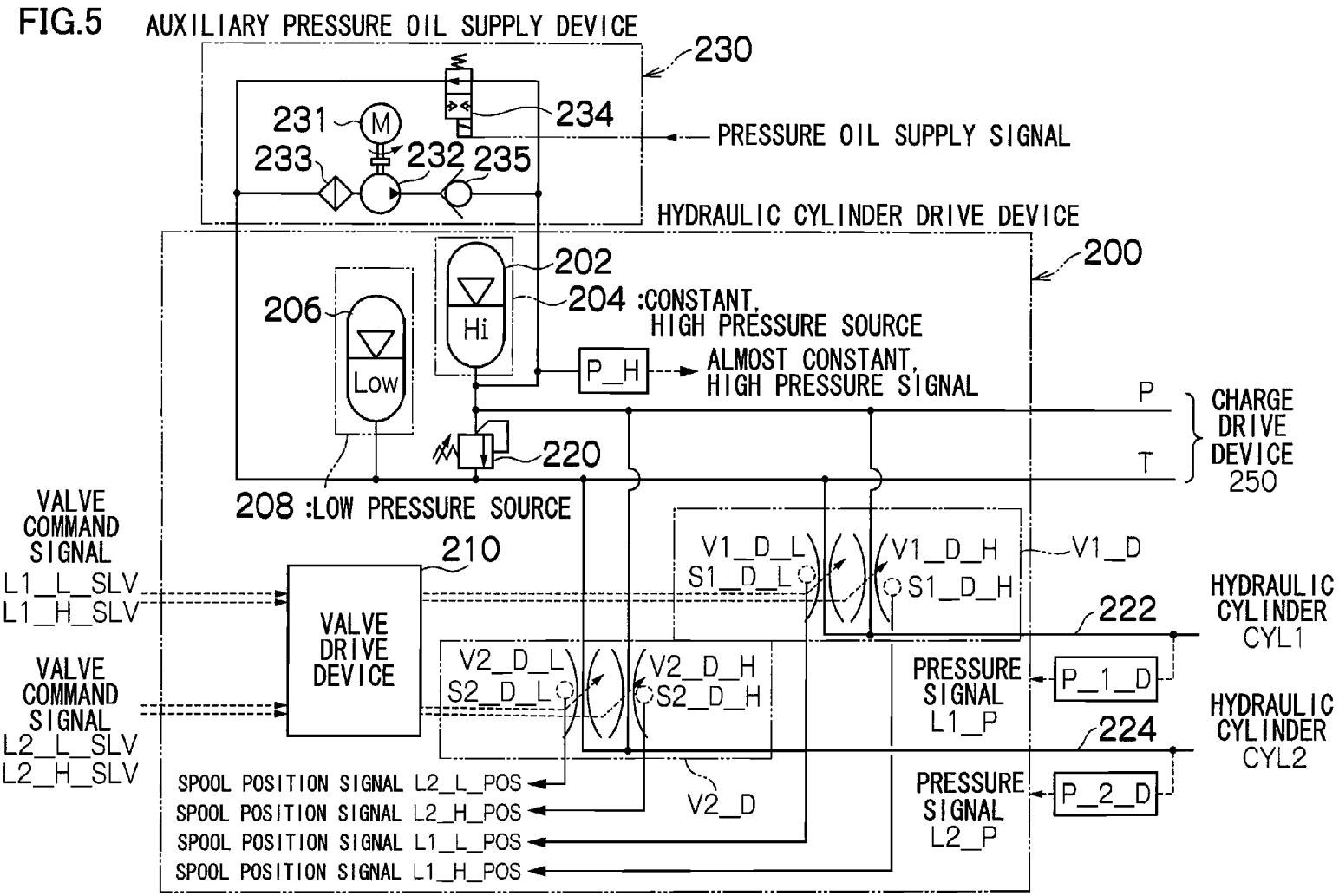
FIG. 5 is a hydraulic circuit diagram illustrating an internal configuration of a hydraulic cylinder drive device and an auxiliary pressure oil supply device shown in FIG. 1.

A hydraulic cylinder drive device 200' of the this includes a first hydraulic cylinder drive device 200*a* and a second hydraulic cylinder drive device 200*b*, and each hydraulic cylinder drive device is configured similarly to the hydraulic cylinder drive device 200 shown in FIG. 5. To the first hydraulic cylinder drive device 200*a*, the hydraulic cylinders SYL1*a*, SYL2*a* on the left side of FIG. 29 are connected through pipe lines 222*a*, 224*a*, and to the second hydraulic cylinder drive device 200*b*, the hydraulic cylinders SYL1*b*, SYL2*b* on the right side of FIG. 29 are connected through pipe lines 222*b*, 224*b*.

On the one hand, to the first hydraulic cylinder drive device 200*a*, valve command signals L1_L_SLVa, L1_H_SLVa, L2_L_SLVa, L2_H_SLVa are provided, and to the second hydraulic cylinder drive device 200*b*, valve command signals L1_L SLVb, L1_H_SLVb, L2_L SLVb, L2_H_SLVb are provided. These valve command signals L1_L_SLVa, L1_H_SLVa, L2_L_SLVa, L2_H_SLVa, and the valve command signals L1_L_SLVb, L1_H_SLVb, L2_L_SLVb, L2_H_SLVb are created respectively by a hydraulic cylinder controller in the slide control device not shown.

That is, this hydraulic cylinder drive device 200' drives the hydraulic cylinders SYL1*a*, SYL2*a* on the left side and the hydraulic cylinders SYL1*b*, SYL2*b* on the right side by the first hydraulic cylinder drive device 200*a* and the second hydraulic cylinder drive device 200*b*, respectively.

Accordingly, the slide drive device of a press machine of this embodiment drives and controls the left electric motor SMa and the right electric motor SMb of the press machine 100", respectively, and at the same time, controls the left hydraulic cylinders SYL1*a*, SYL2*a* and the right hydraulic cylinders SYL1*b*, SYL2*b*, respectively, whereby, even when eccentric press load is applied to the slide 110, thrust corresponding to the eccentric press load can be applied, maintaining parallelism of the slide 110 to be highly accurate.

In addition, in this embodiment, a slide position signal indicating a position of the slide 110 is used, but a drive shaft angle signal may be used, and further, a drive shaft angular velocity is used as a velocity signal, but a slide velocity may be used. Moreover, a position feedback configuration with velocity minor loop feedback is used for controlling, but only the velocity feedback configuration may be used for controlling. Further, in this embodiment, an example where oil is used as working fluid has been described, but not limited to this, water or another liquid may be used. Further, the present invention is not limited to a slide (movable platen) of a press machine, but it may be also applied to a drive device of a movable platen in industrial machinery or construction equipment requiring various thrusts, for example, a die plate in an injection molding machine.

The present invention can be applied to a drive device of a movable platen and a slide drive device of a press machine. Especially, the present invention can be applied to technologies for driving a slide of a press machine, and a movable platen in industrial machinery and construction equipment requiring various thrusts, with using an electric motor and a hydraulic cylinder together.

The invention claimed is:

1. A drive device of a movable platen, comprising:

an electric motor device includes an electric motor;

a screw/nut mechanism which transfers output torque of the electric motor to the movable platen as thrust to move the movable platen;

at least one hydraulic cylinder connected to a constant, high pressure source for generating working fluid of an almost constant pressure and a low pressure source via a valve;

a thrust transfer device which transfers thrust of the at least one hydraulic cylinder to the movable platen and linking to allow the thrust to be transferred as required at an arbitrary stroke position of the screw/nut mechanism;

a velocity detecting device which detects a velocity of the movable platen or an angular velocity of any rotation part disposed between a drive shaft of the electric motor device and the screw/nut mechanism; and a control device which controls the electric motor device and the at least one hydraulic cylinder, based on the velocity or the angular velocity detected by the velocity detecting device, wherein when the thrust generated by the electric motor is insufficient for the thrust to move the platen, the control device controls the electric motor and the hydraulic cylinder to secure the required thrust at the arbitrary stroke position by offset-driving the electric motor and turning on/off the at least one hydraulic cylinder depending on a magnitude of a shortage of the thrust to continuously change a composite thrust of the electric motor and the at least one hydraulic cylinder, the control device makes the at least one hydraulic cylinder serve as a pump during a predetermined period when load of the movable platen is small, and working fluid is charged from the low pressure source to the high pressure source by using thrust transferred from the electric motor device to the at least one hydraulic cylinder through the screw/nut mechanism, the movable platen and the thrust transfer device, and wherein the movable platen is a slide of a press machine.

2. The drive device of a movable platen according to claim 1, wherein a hydraulic device including the constant, high pressure source, the low pressure source and the at least one hydraulic cylinder, in which working fluid circulates, is isolated from the atmosphere.

3. The drive device of a movable platen according to claim 1, wherein the constant, high pressure source includes an accumulator for holding working fluid in a substantially constant, high pressure.

4. The drive device of a movable platen according to claim 1, wherein the low pressure source includes an accumulator for storing working fluid in a tank at the atmosphere or holding the working fluid in a substantially constant, low pressure.

5. The drive device of a movable platen according to claim 1, wherein the constant, high pressure source is connected to a working fluid auxiliary supply device which supplies working fluid of a substantially constant pressure.

6. The drive device of a movable platen according to claim 1, wherein the electric motor device includes a plurality of electrically-operated motors having at least one servo motor.

7. The drive device of a movable platen according to claim 1, wherein output torque of the electric motor device is transferred to the screw/nut mechanism through a speed reducer.

8. The drive device of a movable platen according to claim 1, wherein the at least one hydraulic cylinder includes at least two hydraulic cylinders having a different diameter.

9. The drive device of a movable platen according to claim 1, wherein the at least one hydraulic cylinder includes a pair of hydraulic cylinders having an equal cylinder diameter, the pair of hydraulic cylinders are located at a position symmetrical about the center of the movable platen, respectively, and pressure fluid connecting ports of the pair of hydraulic cylinders are connected to each other so as to allow working fluid to be supplied at the same time.

10. The drive device of a movable platen according to claim 1, wherein a pressure fluid connecting port of the at least one hydraulic cylinder is connected to the low pressure source so as to always communicate with it.

11. The drive device of a movable platen according to claim 1, wherein the movable platen is movably directed vertically, and a pressure fluid connecting port of the at least one hydraulic cylinder on the side of a cylinder lower room is connected to a pilot operated check valve to support a weight of the movable platen when it is not being driven.

12. The drive device of a movable platen according to claim 1, further comprising:

a velocity command device which commands a target velocity of the movable platen or a target angular velocity of the rotation part, wherein the control device controls the electric motor device and the at least one hydraulic cylinder, based on one of the target velocity or the target angular velocity commanded by the velocity command device, and the velocity or the angular velocity detected by the velocity detecting device.

13. The drive device of a movable platen according to claim 1, further comprising:

a position command device which commands a target position of the movable platen or a target angle of the rotation part, and a position detecting device which detects a position of the movable platen or an angle of the rotation part, wherein the control device controls the electric motor device and the at least one hydraulic cylinder, based on the target position or the target angle commanded by the position command device, the position or the angle detected by the position detecting device, and the velocity or the angular velocity detected by the velocity detecting device.

14. The drive device of a movable platen according to claim 13, wherein the control device comprises:

a composite motor torque command computing device which computes a composite motor torque command signal to control the electric motor device, based on the target position or the target angle commanded by the position command device, the position or the angle detected by the position detecting device, and the velocity or the angular velocity detected by the velocity detecting device, and a motor control device which controls the electric motor device, based on the composite motor torque command signal.

15. The drive device of a movable platen according to claim 1, further comprising:

a position command device which commands a target position of the movable platen or a target angle of the rotation part, and a position detecting device which detects a position of the movable platen or an angle of the rotation part, wherein the control device comprises:

a motion base computing device which computes a motion base signal to control the at least one hydraulic cylinder, based on the target position or the target angle commanded by the position command device, the position or the angle detected by the position detecting device, and the velocity or the angular velocity detected by the velocity detecting device, and a cylinder control device which controls the at least one hydraulic cylinder, based on the motion base signal.

16. The drive device of a movable platen according to claim 1, further comprising:

a position command device which commands a target position of the movable platen or a target angle of the rotation part, and a position detecting device which detects a position of the movable platen or an angle of the rotation part, wherein the control device comprises:

a motion base computing device which computes a motion base signal to control the at least one hydraulic cylinder, based on the target position or the target angle commanded by the position command device, the position or the angle detected by the position detecting device, and the velocity or the angular velocity detected by the velocity detecting device, a composite motor torque command computing device which computes a composite motor torque command signal to control the electric motor device, based on the target position or the target angle commanded by the position command device, the position or the angle detected by the position detecting device, and the velocity or the angular velocity detected by the velocity detecting device, a disturbance torque estimating device which computes a disturbance torque estimation signal indicating disturbance torque by estimating the disturbance torque caused due to motion of the movable platen, based on the composite motor torque command signal, and the velocity or the angular velocity detected by the velocity detecting device, and a cylinder control device which controls the at least one hydraulic cylinder, based on the motion base signal and the disturbance torque estimation signal.

17. The drive device of a movable platen according to claim 1, further comprising:

a position command device which commands a target position of the movable platen or a target angle of the rotation part, and a position detecting device which detects a position of the movable platen or an angle of the rotation part, wherein the control device comprises:

a composite motor torque command computing device which computes a composite motor torque command signal to control the electric motor device, based on the target position or the target angle commanded by the position command device, the position or the angle detected by the position detecting device, and the velocity or the angular velocity detected by the velocity detecting device, a disturbance torque estimating device which computes a disturbance torque estimation signal indicating disturbance torque by estimating the disturbance torque caused due to motion of the movable platen, based on the composite motor torque command signal, and the velocity or the angular velocity detected by the velocity detecting device, and a motor control device which controls the electric motor device, based on the composite motor torque command signal and the disturbance torque estimation signal.

18. The drive device of a movable platen according to claim 1, wherein the control device controls the hydraulic cylinder by controlling opening of the valve.

19. The drive device of a movable platen according to claim 18, characterized in that the control device controls the electric motor, based on responsivity from generation of a command signal for commanding opening of the valve to the time when pressure of the at least one hydraulic cylinder reaches a predetermined value.

20. The drive device of a movable platen according to claim 18, further comprising:

a position command device which commands a target position of the movable platen or a target angle of the rotation part, wherein the control device comprises:

a composite motor torque command computing device which computes a composite motor torque command signal to control the electric motor device, based on the target position or the target angle commanded by the position command device, the position or the angle detected by the position detecting device, and the velocity or the angular velocity detected by the velocity detecting device, and a motor control device which controls the electric motor device, based on the composite motor torque command signal, first responsivity from generation of a command signal for commanding opening of the valve to the time when pressure of the hydraulic cylinder reaches a predetermined value, and second responsivity from commanding a torque command or a current command to the electric motor to the time when the commanded torque or current is reached.

21. The drive device of a movable platen according to claim 1, comprising:

a position command device which commands a target position of the movable platen or a target angle of the rotation part, and a pressure detecting device which detects a pressure of the hydraulic cylinder, characterized in that the control device comprises:

a composite motor torque command computing device which computes a composite motor torque command signal to control the electric motor device, based on the target position or the target angle commanded by the position command device, the position or the angle detected by the position detecting device, and the velocity or the angular velocity detected by the velocity detecting device, and a motor control device which controls the electric motor, based on the composite motor torque command signal and the pressure detected by the pressure detecting device.

22. The drive device of a movable platen according to claim 1, further comprising:

a pressure detecting device which detects a pressure of the at least one hydraulic cylinder, and an opening detecting device which detects opening of the valve, wherein the control device comprises:

a computing device which computes a hydraulic cylinder control signal to control the at least one hydraulic cylinder, based on the velocity or the angular velocity detected by the velocity detecting device, and a cylinder control device which controls the at least one hydraulic cylinder, based on the hydraulic cylinder control signal, the pressure detected by the pressure detecting device, and the opening detected by the opening detecting device.

23. The drive device of a movable platen according to claim 21, wherein the computing device computes a hydraulic cylinder control signal indicating a cylinder pressure changing between two steady states, including a state of constant, low pressure and a state of a substantially constant, high pressure, and the cylinder control device controls the at least one hydraulic cylinder only during a transient period of the cylinder pressure of the at least one hydraulic cylinder which changes between the two steady states, based on the hydraulic cylinder control signal, the pressure detected by the pressure detecting device, and the opening detected by the opening detecting device.

24. The drive device of a movable platen according to claim 1, wherein the valve comprises a first valve intervening between the constant, high pressure source and the hydraulic cylinder, and a second valve intervening between the low pressure source and the hydraulic cylinder, and the control device controls the first and second valve in a manner that the second valve is opened after the first valve is closed, or the first valve is opened after the second valve is closed.

25. The drive device of a movable platen according to claim 1, wherein the control device comprises:

a computing device which computes a hydraulic cylinder control signal indicating a cylinder pressure changing between two steady states, including a state of a substantially constant, low pressure (P0) and a state of a substantially constant, high pressure (P1), and a valve control device which controls the valve, based on the hydraulic cylinder control signal, wherein the valve has opening and responsivity where change in pressure at least equal to more than 50% of $|P1-P0|$ can be achieved between the two steady states within 60 msec at the latest from the time of change of the hydraulic cylinder control signal.

26. The drive device of a movable platen according to claim 1, further comprising:

an acceleration detecting device which detects an acceleration of the movable platen or an angular acceleration of the rotation part, wherein the control device makes the at least one hydraulic cylinders work as a pump, based on the angular velocity or the angular acceleration detected by the acceleration detecting device.

27. The drive device of a movable platen according to claim 26, wherein the acceleration detecting device computes the acceleration or the angular acceleration, based on the velocity or the angular velocity detected by the velocity detecting device.

28. The drive device of a movable platen according to claim 12, wherein the control device comprises an acceleration computing device which computes an angular velocity or an angular acceleration, based on the target velocity or the target angular velocity commanded by the velocity command device, and makes the at least one hydraulic cylinders work as a pump, based on the angular velocity or the angular acceleration computed.

29. The drive device of a movable platen according to claim 1, wherein two or more electric motor devices are connected to one screw/nut drive mechanism.

30. The drive device of a movable platen according to claim 1, wherein at least one additional screw/nut drive mechanism is provided for the movable platen, and an electric motor device is separately provided for each screw/nut drive mechanism.

31. The drive device of a movable platen according to claim 1, wherein the at least one hydraulic cylinder has a plurality of independent, pressure receiving surfaces capable of operating in the same direction.

32. The drive device of a movable platen according to claim 30, further comprising:

a position command device which commands a target position of the movable platen or a target angle of the rotation part, a first position detecting device which detects a position of the movable platen or an angle of the rotation part, and a second position detecting device which detects a position of the movable platen other than the position detected by the first position detecting device, or an angular velocity of a rotation part associated with the screw/nut drive mechanism other than the rotation part in the plurality of the screw/nut drive mechanisms disposed in the movable platen, wherein the velocity detecting device comprises:

a first velocity detecting device which detects a velocity of the movable platen at a position or an angular velocity of any rotation part disposed between the drive shaft of the electric motor and the screw/nut mechanism, and a second velocity detecting device which detects a velocity of the movable platen at a position other than the position at which the first velocity detecting device detects the velocity of the movable platen, or an angular acceleration of a rotation part associated with the screw/nut drive mechanism other than the rotation part in the plurality of the screw/nut drive mechanisms disposed in the movable platen, and the control device controls a plurality of the electric motor devices and the at least one hydraulic cylinder, based on the target position or the target angle commanded by the position command device, the position or the angle detected by the first and second position detecting devices, and the velocity or the angular velocity detected by the first and second velocity detecting devices.

33. The drive device of a movable platen according to claim 32, wherein the control device comprises:

a first composite motor torque command computing device which computes a first composite motor torque command signal to control a first electric motor device of the plurality of the electric motor devices, based on the target position or the target angle commanded by the position command device, the position or the angle detected by the first position detecting device, and the velocity or the angular velocity detected by the first velocity detecting device, a second composite motor torque command computing device which computes a second composite motor torque command signal to control a second electric motor device for driving the screw/nut drive mechanism other than the one driven by the first electric motor device, based on the target position or the target angle commanded by the position command device, the position or the angle detected by the second position detecting device, and the velocity or the angular velocity detected by the second velocity detecting device, a first disturbance torque estimating device which computes a first disturbance torque estimation signal indicating first disturbance torque by estimating the first disturbance torque caused due to motion of the movable platen, based on the first composite motor torque command signal, and the velocity or the angular velocity detected by the first velocity detecting device, a second disturbance torque estimating device which computes a second disturbance torque estimation signal indicating second disturbance torque by estimating the second disturbance torque caused due to motion of the movable platen, based on the second composite motor torque command signal, and the device which or the angular device which detected by the second device which detecting device, a first motor control device which controls the first electric motor device, based on the first composite motor torque command signal and the first disturbance torque estimation signal, and a second motor control device which controls the second electric motor device, based on the second composite motor torque command signal and the second disturbance torque estimation signal.

34. The drive device of a movable platen according to claim 1, further comprising:

a position command device which commands a target position of the movable platen or a target angle of the rotation part, and a position detecting device which detects a position of the movable platen or an angle of the rotation part, wherein the at least one hydraulic cylinder includes a plurality of hydraulic cylinders disposed for the movable platen, the velocity detecting device comprises:

a first velocity detecting device which detects a velocity of the movable platen or an angular velocity of any rotation part disposed between the drive shaft of the electric motor and the screw/nut mechanism, and a second velocity detecting device which detects a velocity of the movable platen at a position other than the position at which the first velocity detecting device detects the velocity of the movable platen, or an angular acceleration of a rotation part associated with the screw/nut drive mechanism other than the rotation part in a plurality of the screw/nut drive mechanisms disposed in the movable platen, and the control device comprises:

a composite motor torque command computing device which computes a composite motor torque command signal to control the electric motor device, based on the target position or the target angle commanded by the position command device, the position or the angle detected by the position detecting device, and at least one velocity or angular velocity of the velocities or the angular velocities detected by the first and second velocity detecting devices, respectively, a motion base computing device which computes a motion base signal to control the at least one hydraulic cylinder, based on the target position or the target angle commanded by the position command device, the position or the angle detected by the position detecting device, and at least one velocity or angular velocity of the velocities or the angular velocities detected by the first and second velocity detecting devices, respectively, a first disturbance torque estimating device which computes a disturbance torque estimation signal indicating first disturbance torque by estimating the first disturbance torque caused due to motion of the movable platen, based on the composite motor torque command signal, and the velocity or the angular velocity detected by the first velocity detecting device, a second disturbance torque estimating device which computes a disturbance torque estimation signal indicating second disturbance torque by estimating the second disturbance torque caused due to motion of the movable platen, based on the composite motor torque command signal, and the velocity or the angular velocity detected by the second velocity detecting device, a first cylinder control device which controls a first hydraulic cylinder of the plurality of the hydraulic cylinders, based on the motion base signal and the first disturbance torque estimation signal, and a second cylinder control device which controls a second hydraulic cylinder of the plurality of the hydraulic cylinders, based on the motion base signal and the second disturbance torque estimation signal.

35. The drive device of a movable platen according to claim 34, wherein a plurality of the screw/nut drive mechanisms are provided for one movable platen, an electric motor device is separately provided for each screw/nut drive mechanism, the position detecting device comprises:

a first position detecting device which detects a position of the movable platen or an angle of the rotation part, and a second position detecting device which detects a position of the movable platen rather than the position which the first position detecting device detects, or an angular velocity of a rotation part associated with the screw/nut drive mechanism rather than the rotation part in the plurality of the screw/nut drive mechanisms disposed in the movable platen, the composite motor torque command signal computing device comprises:

a first composite motor torque command computing device which computes a first composite motor torque command signal to control a first electric motor of a plurality of the electric motors, based on the target position or the target angle commanded by the position command device, the position or the angle detected by the first position detecting device, and the velocity or the angular velocity detected by the first velocity detecting device, and a second composite motor torque command computing device which computes a second composite motor torque command signal to control a second electric motor of the plurality of the electric motors, based on the target position or the target angle commanded by the position command device, the position or the angle detected by the second position detecting device, and the velocity or the angular velocity detected by the second velocity detecting device, wherein the first disturbance torque estimating device computes a disturbance torque estimation signal indicating first disturbance torque by estimating the first disturbance torque caused due to motion of the movable platen, based on the first composite motor torque command signal, and the velocity or the angular velocity detected by the first velocity detecting device, and the second disturbance torque estimating device computes a disturbance torque estimation signal indicating second disturbance torque by estimating the second disturbance torque caused due to motion of the movable platen, based on the second composite motor torque command signal, and the velocity or the angular velocity detected by the second velocity detecting device.

* * * * *